US009085162B2

(12) United States Patent
Tsuyama et al.

(10) Patent No.: US 9,085,162 B2
(45) Date of Patent: Jul. 21, 2015

(54) RECORDING APPARATUS

(71) Applicant: SEIKO EPSON CORPORATION, Tokyo (JP)

(72) Inventors: Kazuhiko Tsuyama, Kitakyushu (JP); Ryoichi Shuto, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/444,600

(22) Filed: Jul. 28, 2014

(65) Prior Publication Data

US 2015/0035902 A1 Feb. 5, 2015

(30) Foreign Application Priority Data

Jul. 31, 2013 (JP) ..... 2013-158647
Mar. 25, 2014 (JP) ..... 2014-062082
Jun. 13, 2014 (JP) ..... 2014-122129

(51) Int. Cl.
*B41J 2/185* (2006.01)
*B41J 2/01* (2006.01)
*B41J 2/17* (2006.01)
*B41J 2/175* (2006.01)

(52) U.S. Cl.
CPC ..... *B41J 2/1721* (2013.01); *B41J 2/1752* (2013.01); *B41J 2002/1728* (2013.01)

(58) Field of Classification Search
CPC ..... B41J 2/1752
USPC ..... 347/86, 87, 8; 210/236
See application file for complete search history.

(56) References Cited

U.S. PATENT DOCUMENTS 5,805,187 A * 9/1998 Sasaki ..... 347/86
5,852,452 A * 12/1998 Imai ..... 347/8
6,220,314 B1 * 4/2001 Sato ..... 141/351
6,863,388 B2 * 3/2005 Seino et al. ..... 347/86
6,942,328 B2 * 9/2005 Haldorsen ..... 347/87
7,828,415 B2 * 11/2010 Kawamura ..... 347/49
2009/0218271 A1 9/2009 Harada

FOREIGN PATENT DOCUMENTS

JP 2009-269208 11/2009
JP 2012-091408 5/2012
JP 2012-139823 7/2012

* cited by examiner

*Primary Examiner* — Stephen Meier
*Assistant Examiner* — John P Zimmermann
(74) *Attorney, Agent, or Firm* — Workman Nydegger

(57) ABSTRACT

A recording apparatus includes an apparatus main body which includes an accommodation chamber for detachably accommodating a cartridge capable of accommodating liquid and a cover which opens and closes the accommodation chamber, a gap is formed in the accommodation chamber when the cartridge is attached to the accommodation chamber, and a stopper unit provided at the cover enters the gap when the cover is closed in a state where the cartridge is attached to the accommodation chamber.

14 Claims, 23 Drawing Sheets

RECORDING APPARATUS

BACKGROUND

1. Technical Field

The present invention relates to a recording apparatus, representative examples of which include a facsimile and a printer.

2. Related Art

As a recording apparatus in the related art, an ink jet printer which executes recording by ejecting ink from openings of nozzles in a recording head to a recording medium has widely been used. In such an ink jet printer, a maintenance operation of forcibly ejecting or suctioning the ink from the nozzles is periodically performed in order to prevent the ink from drying in the nozzles for ejecting the ink.

In addition, there is an ink jet printer which is provided with a waste liquid cartridge for keeping waste ink in order to absorb and store the waste ink which is ejected or suctioned during the maintenance operation (see JP-A-2009-269208). The printer disclosed in JP-A-2009-269208 is configured based on a snap-fit scheme in which the waste liquid cartridge is fitted into and detachably fixed to a cartridge accommodation unit.

The ink jet printer is configured such that the waste liquid cartridge is detached from the printer if the amount of the waste ink which is kept in the waste liquid cartridge becomes equal to or greater than a predetermined amount and a new waste liquid cartridge is attached.

Although an ink jet printer is usually used while installed on a flat installation surface, there are many cases where a small-sized light ink jet printer with mobility is arranged in postures other than a horizontal posture during carriage or usage of the ink jet printer. Furthermore, and there are many cases where vibration or impact due to dropping is applied thereto during the carriage or the like.

If an ink cartridge or a waste liquid cartridge is attached to the ink jet printer with mobility based on a snap-fit scheme, there is a concern in that an engagement state between a cartridge accommodation unit and the ink cartridge or the waste liquid cartridge is released due to the impact at the time of dropping or the vibration during the carriage. If the engagement state is released, there is a concern in that a part of the ink or the waste ink kept in the ink cartridge or the waste liquid cartridge bleeds and that not only the cartridge accommodation unit but also the inside and the outside of other parts in the ink jet printer are contaminated by the ink or the waste ink.

According to a scheme for the ink jet apparatus with mobility, in which the ink cartridge or the waste liquid cartridge is fixed to the printer with screws or the like, it is necessary to prepare a tool for replacing the ink cartridge or the waste liquid cartridge, and there is a concern in that it is not possible to quickly replace the ink cartridge or the waste liquid cartridge.

SUMMARY

An advantage of some aspects of the invention is to provide a recording apparatus, in which an ink cartridge or a waste liquid cartridge can be easily replaced, and which can prevent the ink cartridge or the waste liquid cartridge from accidentally dropping out.

According to an aspect of the invention, there is provided a recording apparatus including: an apparatus main body which includes an accommodation chamber for detachably accommodating a cartridge that accommodates liquid; and a cover which opens and closes the accommodation chamber, in which when the cartridge is attached to the accommodation chamber, a gap is formed in the accommodation chamber, and in which when the cover is closed in the state where the cartridge is attached to the accommodation chamber, a stopper unit provided at the cover enters the gap.

According to the aspect, the gap is formed in the accommodation chamber when the cartridge is attached to the accommodation chamber, the stopper unit provided at the cover enters the gap when the cover is closed in this state, and therefore, it is possible to restrict displacement of the cartridge in the accommodation chamber. Therefore, it is possible to further restrict the displacement of the cartridge in the accommodation chamber in the aspect as compared with a configuration in which the stopper unit is not allowed to enter the gap, and to thereby suppress accidental displacement of the cartridge toward the gap, and to reduce or suppress the concern in that the cartridge drops off from the accommodation chamber.

In the recording apparatus, it is preferable that a connected unit which is connected to a liquid flow port provided at the cartridge be provided in the accommodation chamber, that the cartridge be slidable between a first position where the liquid flow port is connected to the connected unit and a second position where the connection to the connected unit is released when attached to the accommodation chamber, and that the stopper unit provided at the cover enter a sliding region where the cartridge slides from the first position to a side of the second position when the cover is closed in a state where the cartridge is at the first position in the accommodation chamber.

In this case, it is possible to attach and detach the cartridge to and from the recording apparatus by causing the cartridge to slide from the second position to the first position in the accommodation chamber and to thereby easily replace the cartridge in the recording apparatus. Furthermore, since the cartridge is securely held at the first position by the stopper unit of the cover entering the sliding region where the cartridge slides from the first position to the second position, it is possible to prevent the cartridge from easily dropping off from the recording apparatus.

In the recording apparatus, it is preferable that the accommodation chamber include an engaging unit which engages with an engaged unit provided at the cartridge when the cartridge is made to slide from the second position to the first position, and that at least one of an engagement sound or a clicking sensation be generated when the engaged unit is engaged with the engaging unit while the cartridge slides from the second position to the first position.

In this case, since at least one of the engagement sound or the clicking sensation is generated when the engaged unit is engaged with the engaging unit while the cartridge is made to slide from the second position to the first position, it is possible for a user to easily recognize that the cartridge has been set at a predetermined position.

In the recording apparatus, it is preferable that the accommodation chamber include a restricting unit which restricts dropping-off of the cartridge from the accommodation chamber, and that a restricted unit, dropping-off of which is restricted by the restricting unit, be not engaged with the restricting unit in the cartridge when the cartridge is at the second position, and that the restricted unit be engaged with the restricting unit by the cartridge sliding from the second position to the first position.

In this case, since the restricting unit engages with the restricted unit by the cartridge sliding from the second position to the first position, it is possible to restrict attachment and detachment of the cartridge to and from the accommodation chamber. That is, it is possible to attach and detach the cartridge to and from the accommodation chamber only at the second position and to thereby prevent the cartridge from accidentally dropping off from the recording apparatus.

In the recording apparatus, it is preferable that the connected unit be biased in a direction from the first position toward the second position.

In this case, since the connected unit is biased in a direction from the first position toward the second position, the connected unit pressurizes the liquid flow port of the cartridge when the cartridge is at the first position in the accommodation chamber, and it is possible to enhance close contact between the liquid flow port and the connected unit. Accordingly, it is possible to suppress leakage of the liquid between the liquid flow port and the connected unit.

In the recording apparatus, it is preferable that the stopper unit of the cover include a guide surface provided at a part which abuts the cartridge when the cover is closed with respect to the apparatus main body.

In this case, since the guide surface is provided at a part which abuts the cartridge, the guide surface pressurizes the cartridge toward the first position even if the cartridge slightly deviates from the first position when the cover is closed with respect to the accommodation chamber, and therefore, it is possible to securely position the cartridge at the first position.

In the recording apparatus, it is preferable that the cartridge accommodate ink which is discharged from the apparatus main body.

In this case, it is possible to configure the cartridge as a cartridge for collecting waste liquid.

In the recording apparatus, it is preferable that the cartridge include an ink absorbing member provided therein.

In the recording apparatus, it is preferable that the cartridge accommodate ink to be supplied to a recording head which is provided in the apparatus main body and eject the ink.

In this case, it is possible to configure the cartridge as an ink supply cartridge for supplying the ink to the recording head.

In the recording apparatus, it is preferable that the apparatus further include: a liquid ejecting head which ejects liquid onto a medium; a medium support unit which is provided at a position where the medium support unit faces the liquid ejecting head and supports the medium; a first liquid storing unit which stores the liquid ejected in a region outside an end of the medium and guided from an upper side to a lower side of the medium support unit; and a second liquid storing unit as the cartridge which stores liquid ejected as waste liquid from the liquid ejecting head, that at least a part of the first liquid storing unit and at least a part of the second liquid storing unit be positioned below the medium support unit, that the first liquid storing unit and the second liquid storing unit be arranged in parallel with a transport direction of the medium, that the medium support unit include a liquid receiving unit which receives the liquid ejected in the region outside the end of the medium, that the liquid receiving unit be provided at a location near an end of the medium support unit on one side in a direction intersecting the transport direction of the medium, that the first liquid storing unit be provided below the liquid receiving unit at a location near the end on the one side in the direction intersecting the transport direction of the medium, and that the second liquid storing unit be provided at a location near an end on the opposite side to the end on the one side.

The medium support unit provided at a position, at which the medium support unit can face the liquid ejecting head, for supporting a medium requires a large space for occupancy in a medium recording surface direction. According to the aspect, both the first liquid storing unit and the second liquid storing unit are arranged by utilizing the region below a medium support unit, and therefore, it is possible to reduce the size of the apparatus.

In addition, since the first liquid storing unit is provided below the liquid receiving unit for receiving the liquid which is ejected to the region outside the end of the medium, it is possible to quickly discharge the liquid from the liquid receiving unit to the first liquid storing unit.

In the recording apparatus, it is preferable that a tube which connects a pump for sending the liquid as the waste liquid to the second liquid storing unit and the second liquid storing unit pass between the first liquid storing unit and the second liquid storing unit and be connected at a position in the second liquid storing unit at which the second liquid storing unit faces the first liquid storing unit.

In this case, since the tube connecting the pump to the second liquid storing unit passes between the first liquid storing unit and the second liquid storing unit and is connected at a position in the second liquid storing unit at which the second liquid storing unit faces the first liquid storing unit, it is not necessary to secure a region for disposing the tube outside the second liquid storing unit, and it is possible to reduce the size of the apparatus.

In the recording apparatus, it is preferable that the first liquid storing unit and the second liquid storing unit be positioned below the medium support unit as a whole.

In this case, since the first liquid storing unit and the second liquid storing unit are positioned below the medium support unit as a whole, it is possible to further reduce the size of the recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
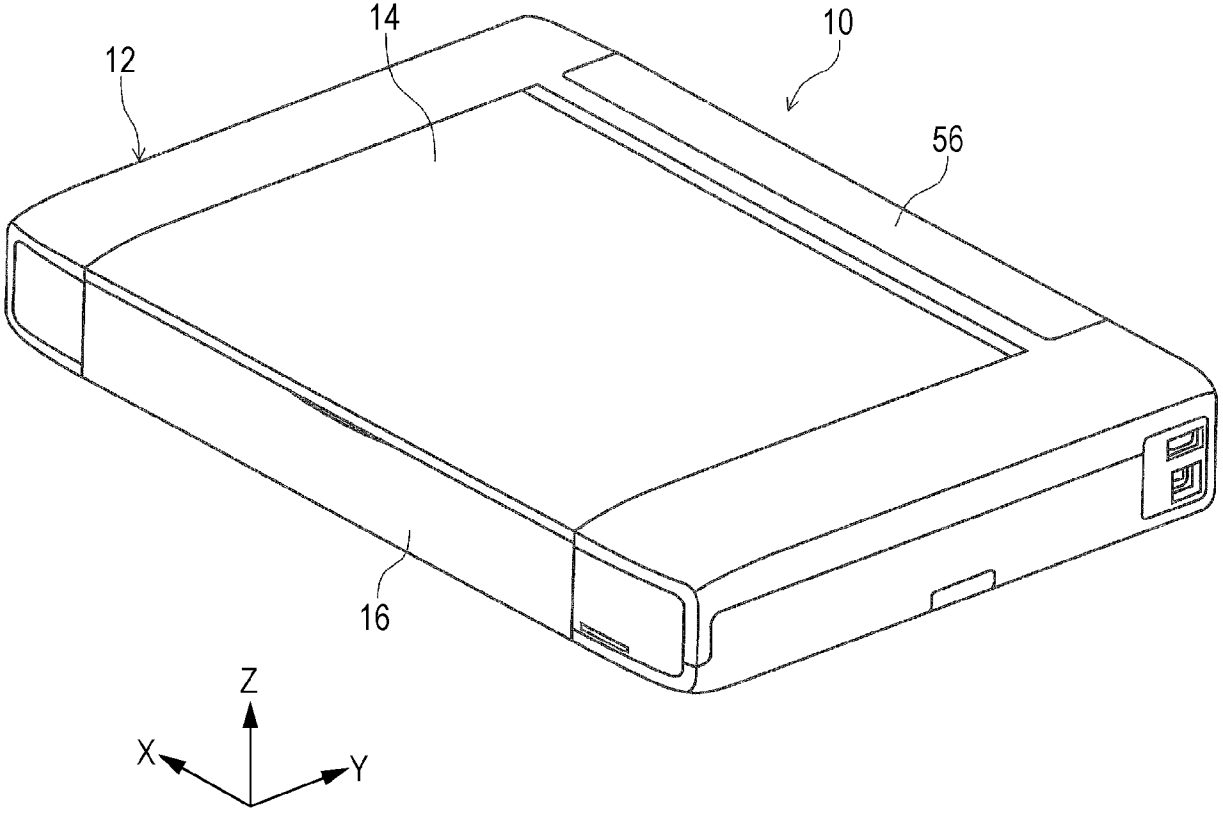
FIG. 1 is a perspective view of a printer according to the invention.

Hereinafter, a description will be given of embodiments of the invention with reference to drawings. The same reference numerals are given to the same configurations in the respective embodiments, the descriptions thereof will be given only in the first embodiment, and the descriptions thereof will be omitted in the following embodiments.

First Embodiment

Hereinafter, a description will be given of a first embodiment of the invention with reference to FIGS. 1 to 11B.

Figure 2:
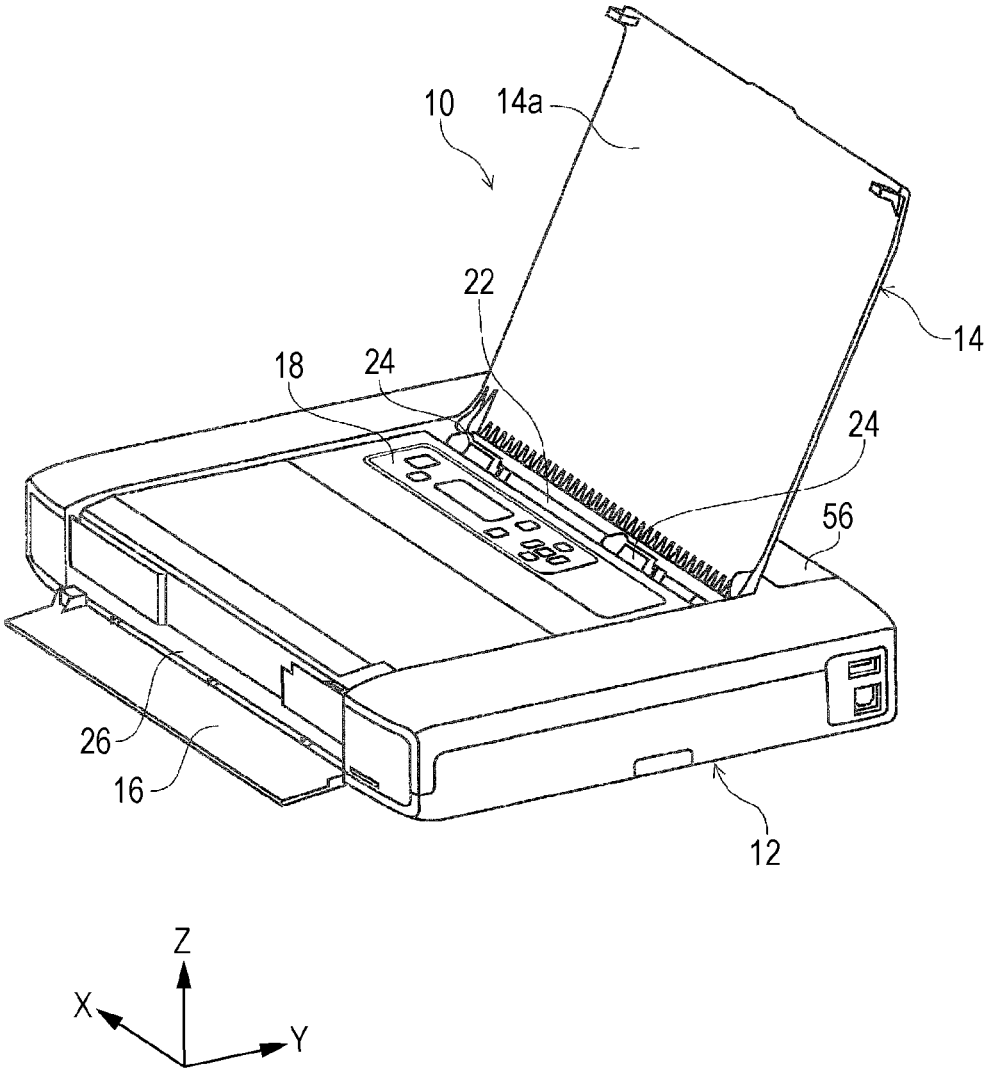
FIG. 2 is a perspective view showing a state where a sheet supply cover in the printer according to the invention is opened.
Figure 3:
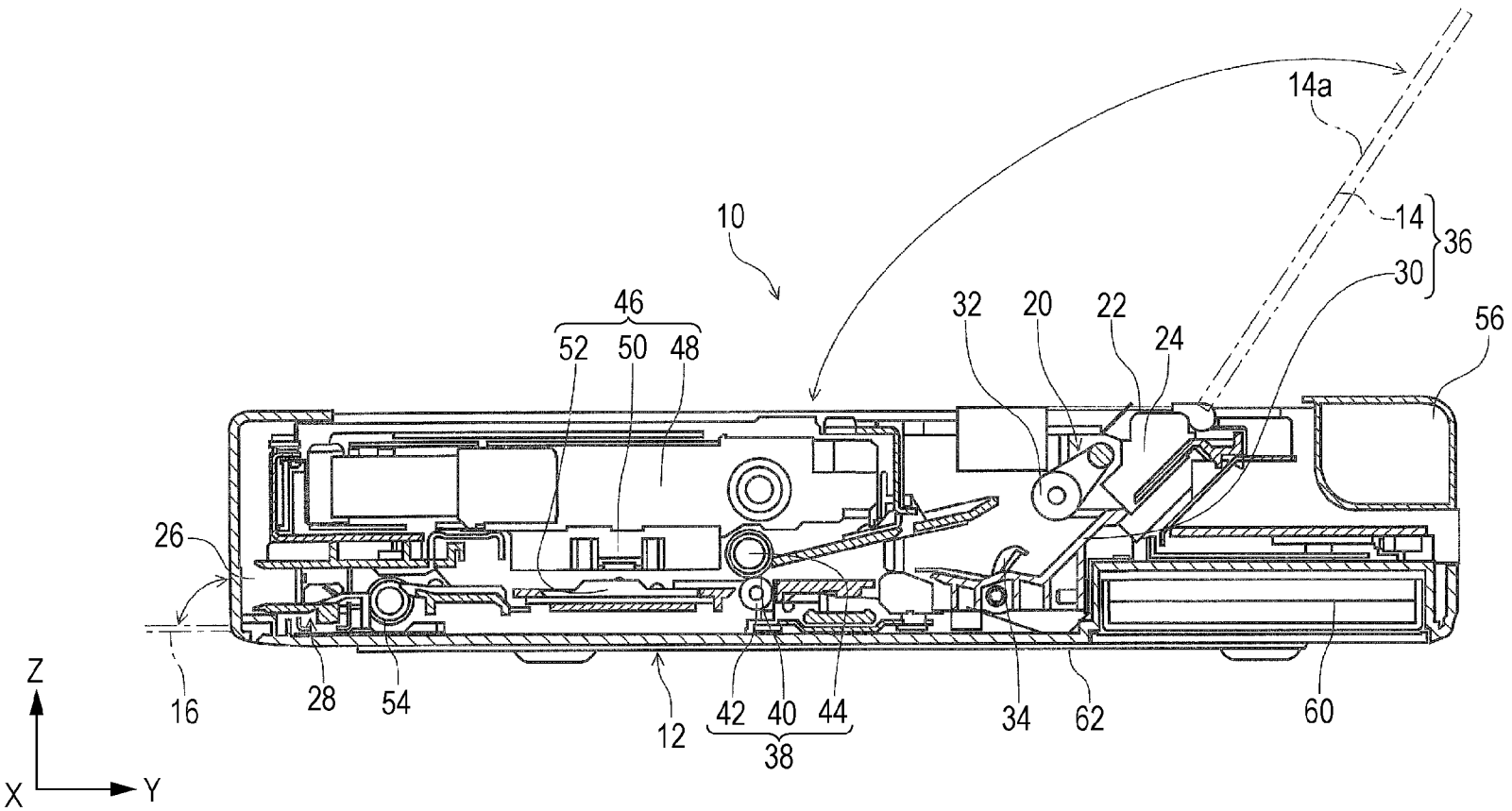
FIG. 3 is a side cross-sectional view showing a sheet transport path in the printer according to the invention.
Figure 4:
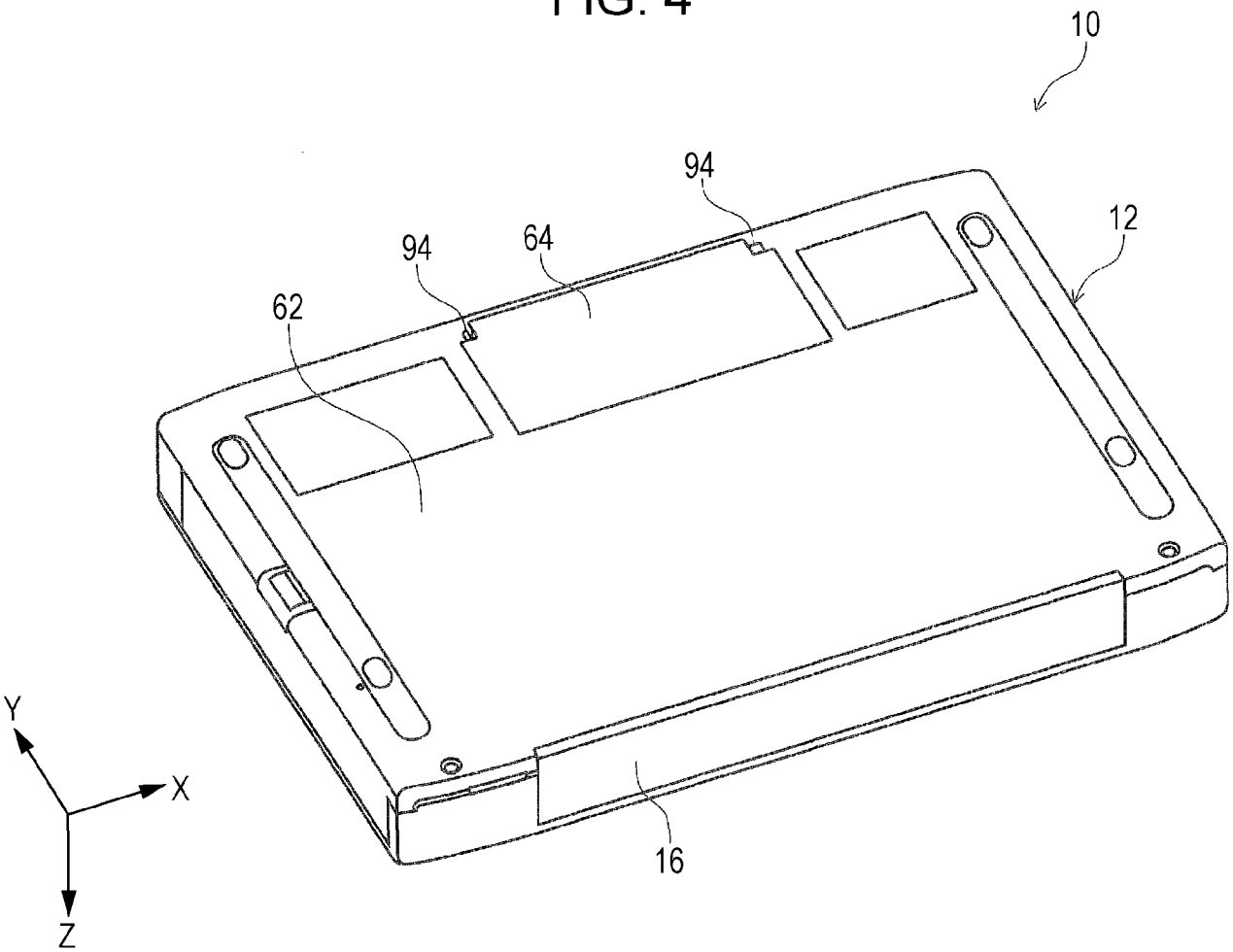
FIG. 4 is a perspective view showing a lower surface of the printer according to the invention.

FIG. 1 is a perspective view of a printer according to the invention, FIG. 2 is a perspective view showing a state where an upper cover in the printer according to the invention is opened, FIG. 3 is a side cross-sectional view showing a sheet transport path in the printer according to the invention, and FIG. 4 is a perspective view showing a lower surface of the printer according to the invention.

Figure 5:
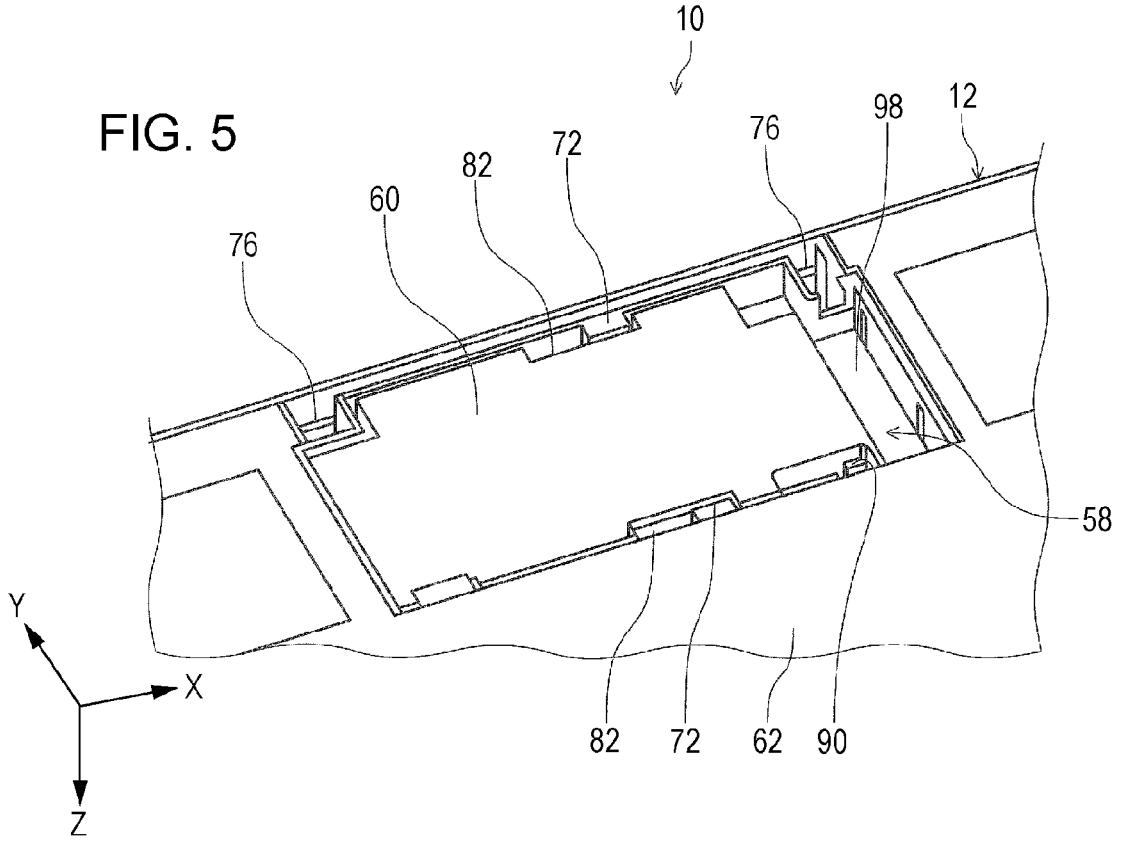
FIG. 5 is a perspective view showing a cartridge accommodation chamber in a state where a cartridge according to the invention is attached.
Figure 6:
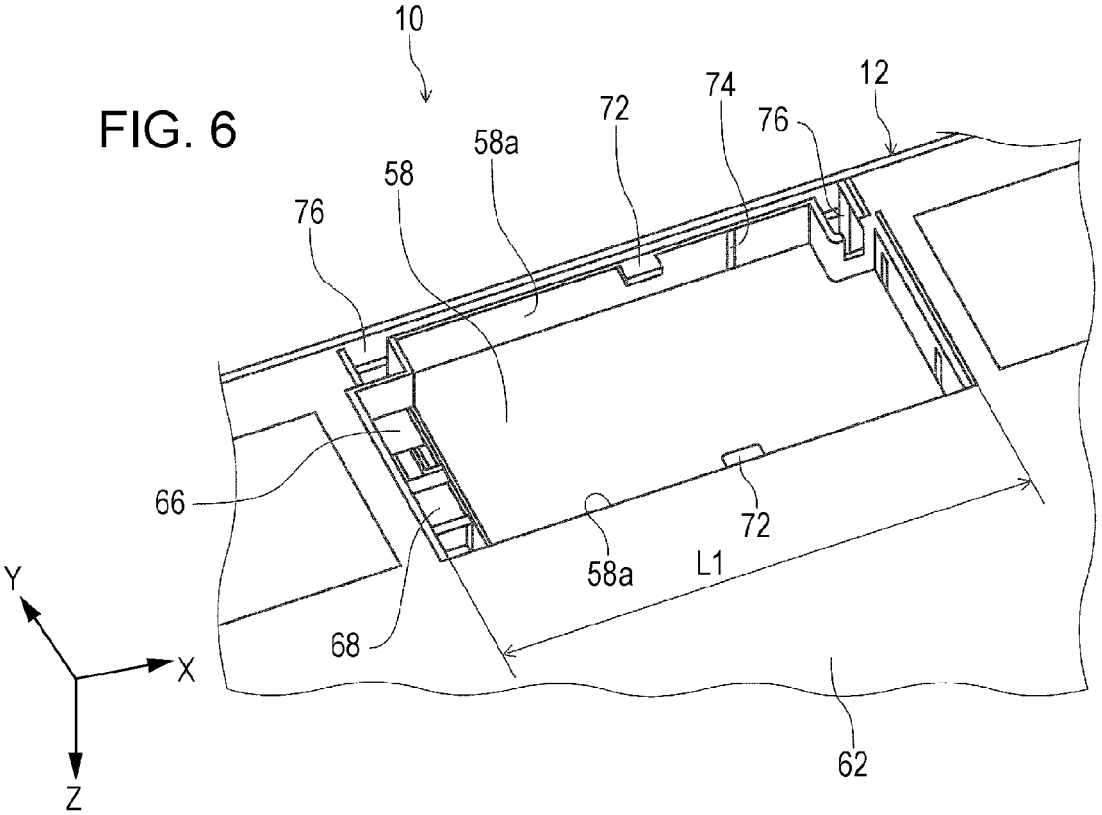
FIG. 6 is a perspective view showing the cartridge accommodation chamber in a state where the cartridge according to the invention is detached.
Figure 7:
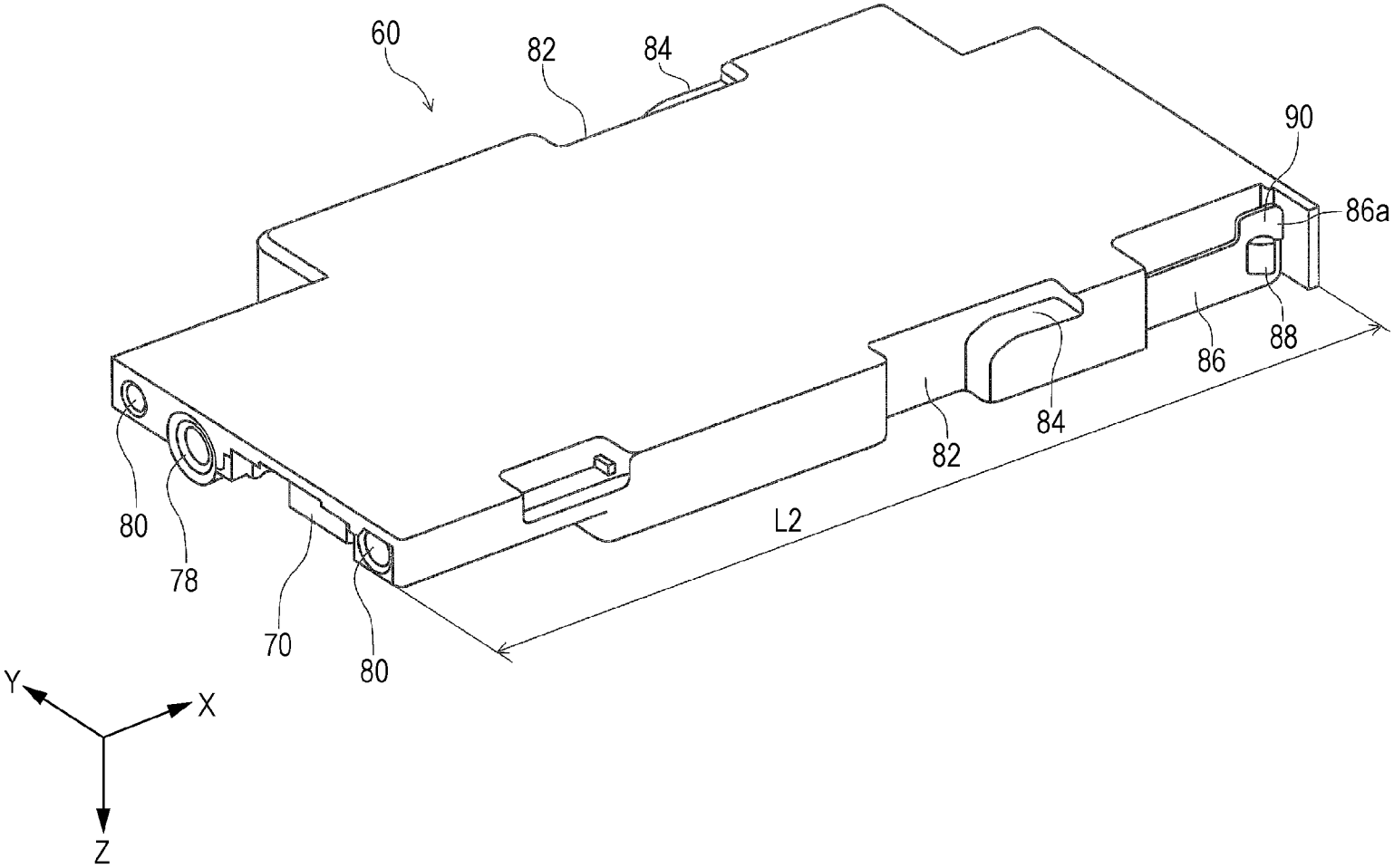
FIG. 7 is a perspective view of the cartridge according to the invention.
Figure 8A:
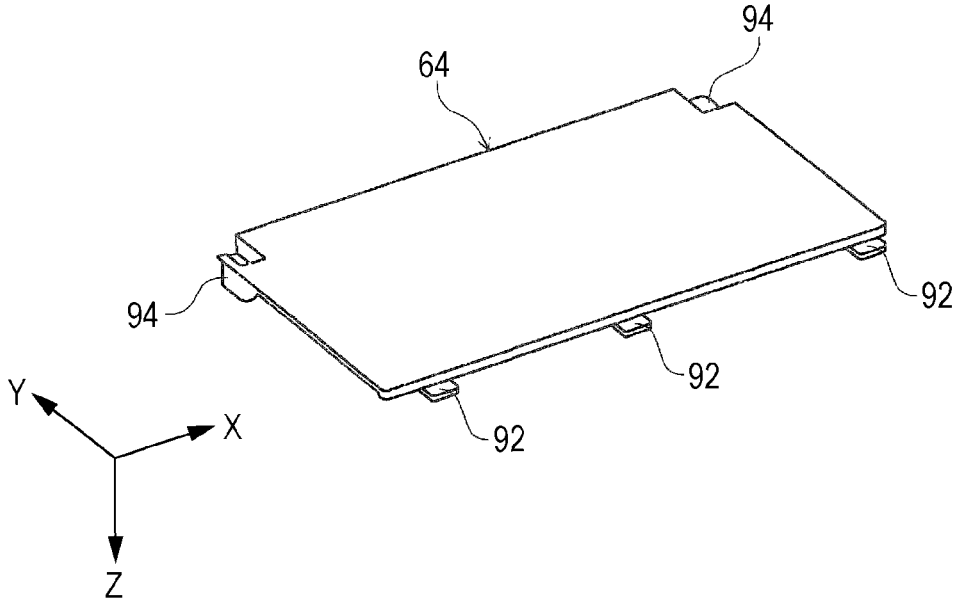
FIGS. 8A and 8B are perspective views of a cover which can be attached to and detached from the accommodation chamber.
Figure 8B:
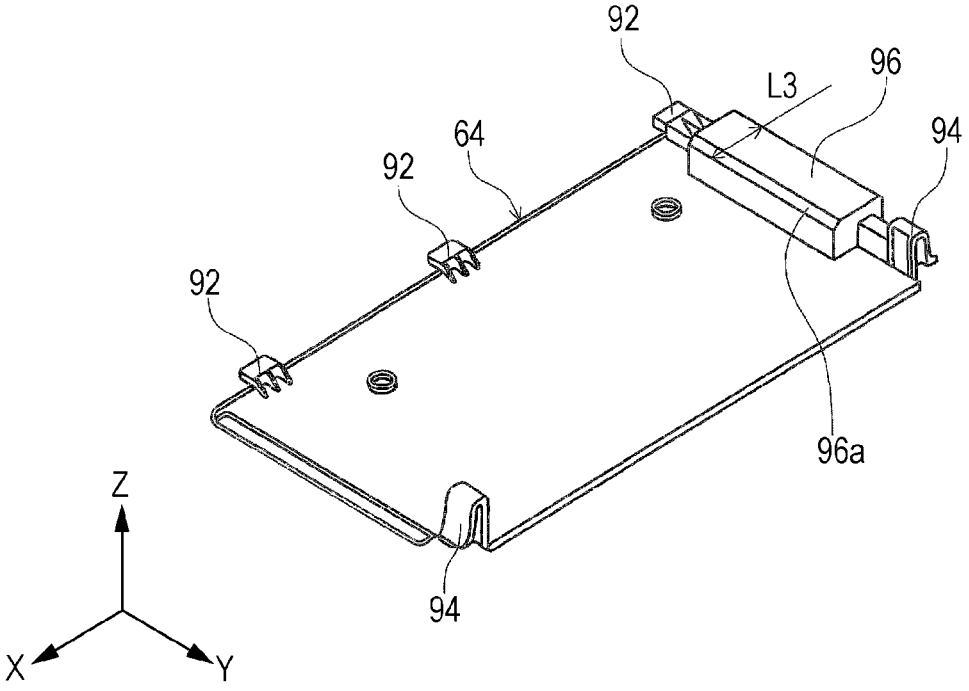

FIG. 5 is a perspective view showing a cartridge accommodation chamber in a state where the cartridge according to the invention is attached, FIG. 6 is a perspective view showing the cartridge accommodation chamber in a state where the cartridge according to the invention is detached, FIG. 7 is a perspective view of the cartridge according to the invention, and FIGS. 8A and 8B are perspective views of the cover which can be attached to and detached from the accommodation chamber.

Figure 9A:
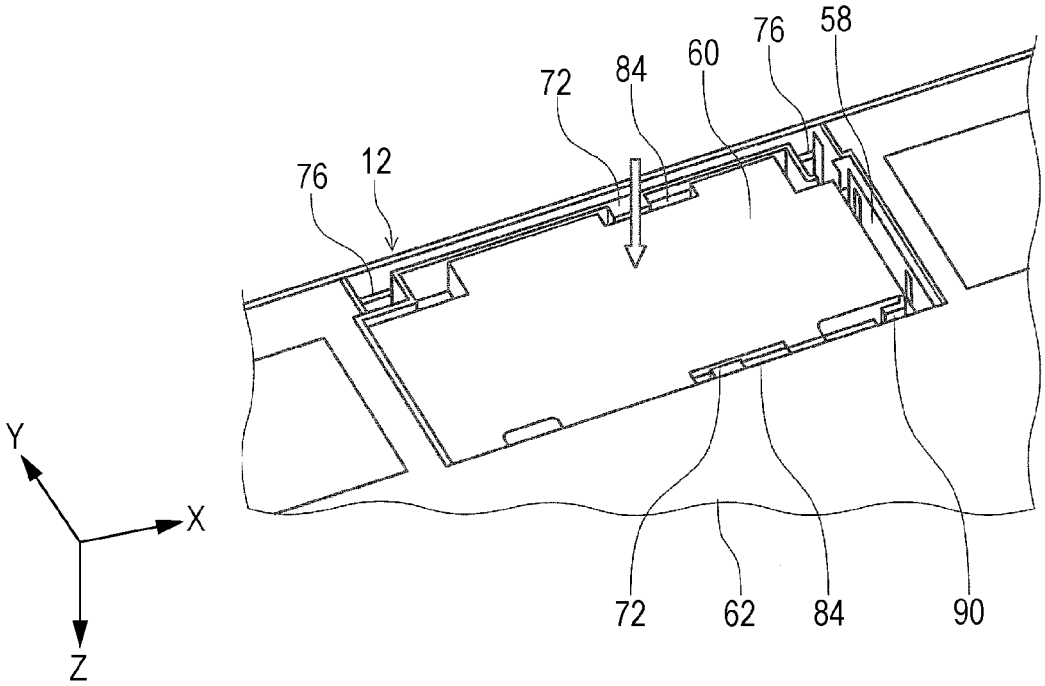
FIG. 9A is a perspective view showing a state where the cartridge is attached at a second position in the accommodation chamber.
Figure 9B:
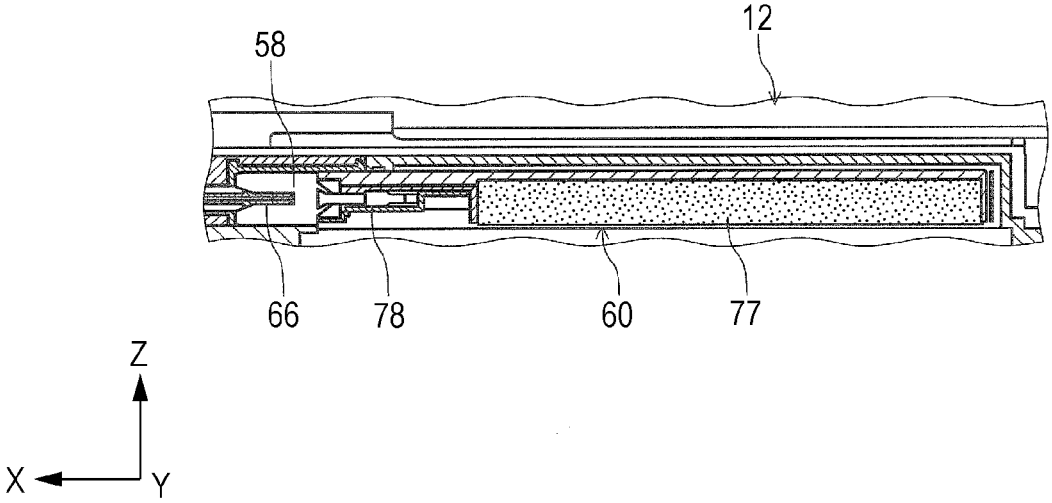
FIG. 9B is a side cross-sectional view in the state shown in FIG. 9A.
Figure 10A:
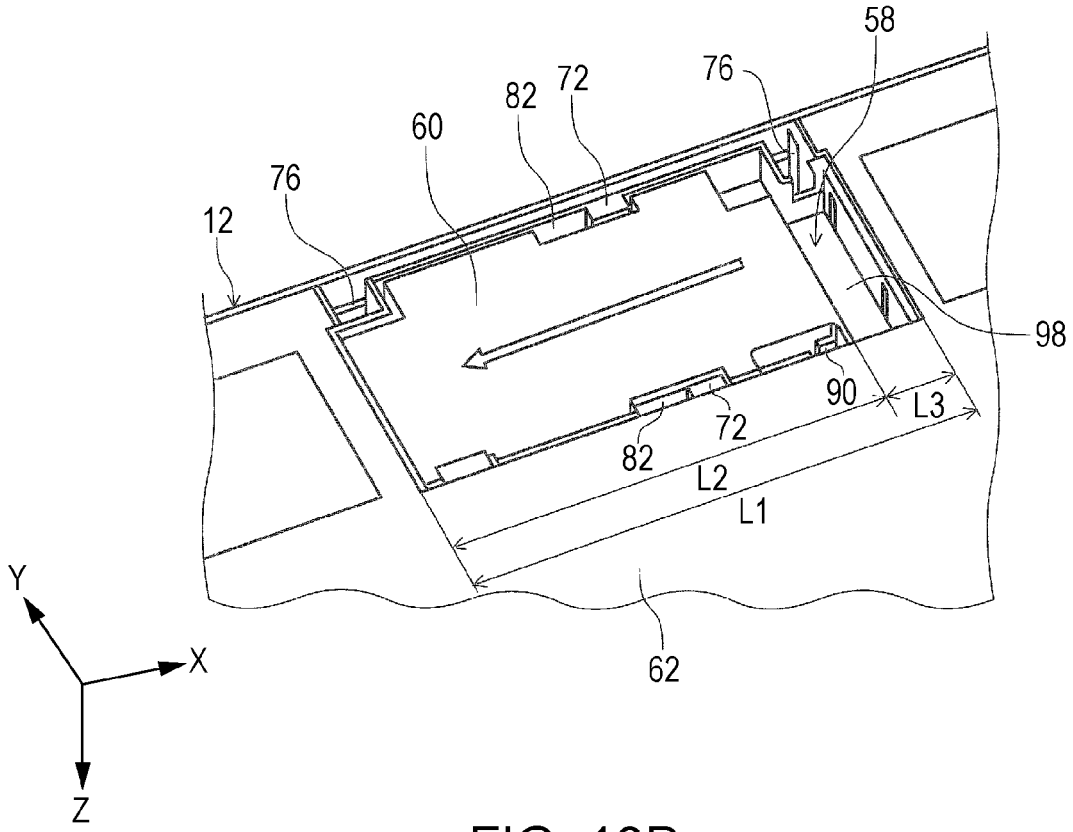
FIG. 10A is a perspective view showing a state where the cartridge is made to slide from the second position to a first position in the accommodation chamber.
Figure 10B:
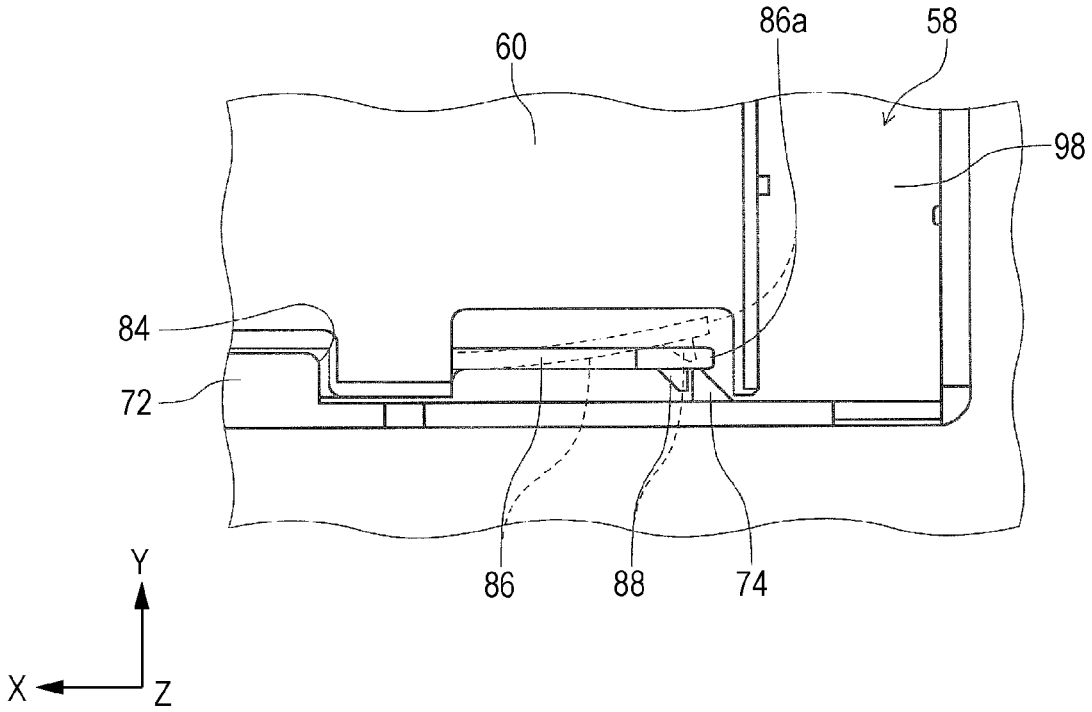
FIG. 10B is an enlarged view showing an engagement state between an engaging unit and an engaged unit when the cartridge is made to slide.
Figure 11A:
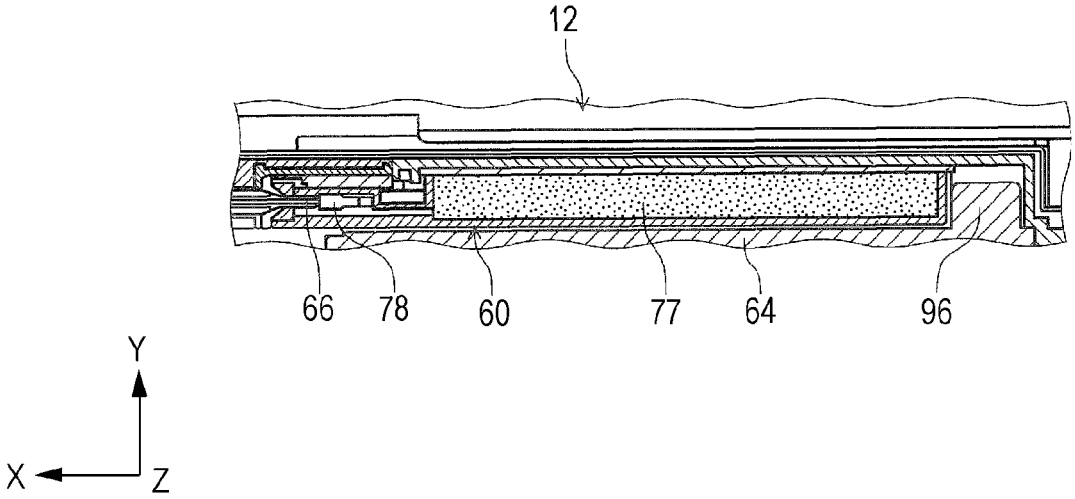
FIG. 11A is a side cross-sectional view when the cartridge is at the first position in the accommodation chamber.
Figure 11B:
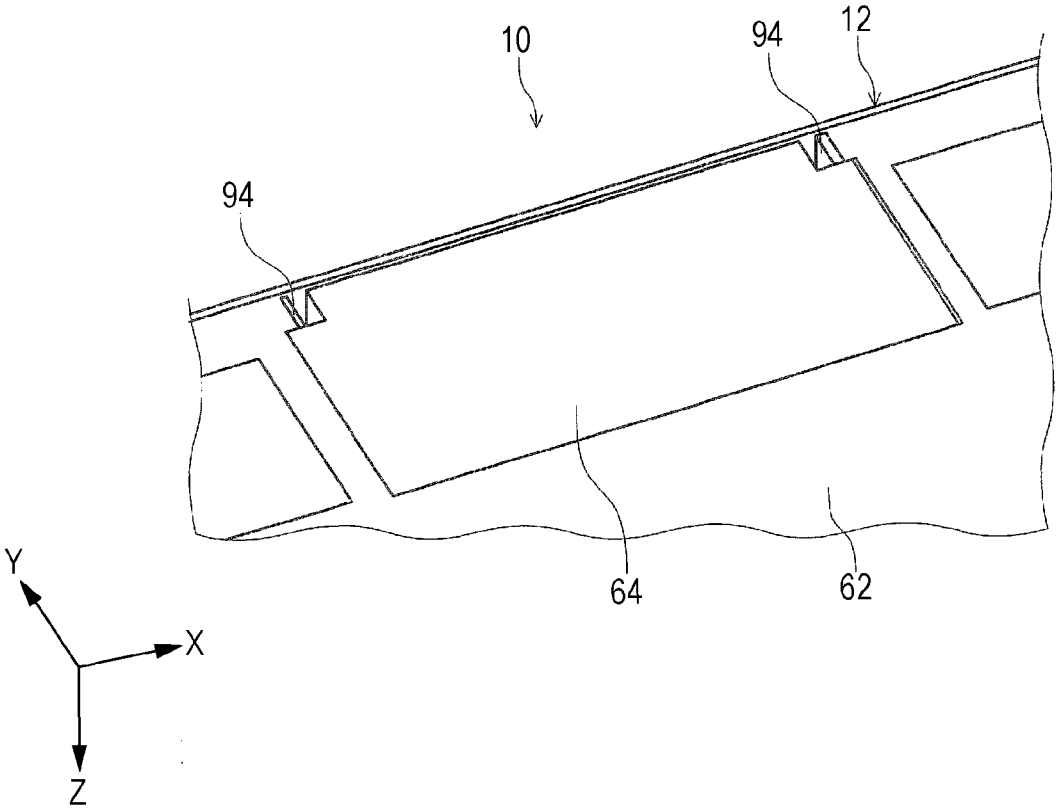
FIG. 11B is a perspective view showing a state where the cover is attached to the accommodation chamber.

FIG. 9A is a perspective view showing a state where the cartridge is attached at a second position in the accommodation chamber, and FIG. 9B is a side cross-sectional view in the state of FIG. 9A. FIG. 10A is a perspective view showing a state where the cartridge is made to slide from the second position to a first position in the accommodation chamber, and FIG. 10B is an enlarged view showing an engagement state between an engaging unit and an engaged unit when the cartridge is made to slide. FIG. 11A is a side cross-sectional view when the cartridge is at the first position in the accommodation chamber, and FIG. 11B is a perspective view showing a state where the cover is attached to the accommodation chamber.

In an X-Y-Z coordinate system shown in each drawing, the X direction corresponds to a scanning direction of a recording head, the Y direction corresponds to a front-back direction of the recording apparatus, and the Z direction corresponds to a direction in which a distance (gap) between the recording head and a medium varies, that is, an apparatus height direction. In each drawing, the −Y direction corresponds to a front surface side of the apparatus, and the +Y direction corresponds to a rear surface side of the apparatus.

Outline of Recording Apparatus

An outline of an entire configuration of a printer 10 will be described with reference to FIGS. 1 and 2. The printer 10 includes an apparatus main body 12, a sheet supply cover 14, a discharge port cover 16, and an operation unit 18 (see FIG. 2).

The sheet supply cover 14 is provided at an upper surface of the printer 10. The sheet supply cover 14 is attached to the upper surface of the apparatus main body 12 so as to be able to turn. The sheet supply cover 14 can be in an opened state (see FIG. 2) and in a closed state (see FIG. 1) with respect to the apparatus main body 12. The sheet supply cover 14 in the closed state with respect to the apparatus main body 12 configures the upper surface of the printer 10 along with the upper surface of the apparatus main body 12.

In addition, the sheet supply cover 14 in the opened state with respect to the apparatus main body 12 (see FIG. 2) is in an inclined state toward the rear surface side (a side of the +Y direction) of the printer 10. In this state, a rear surface of the sheet supply cover 14 functions as a medium support surface 14*a* which supports the medium.

When the sheet supply cover 14 is in the opened state with respect to the apparatus main body 12 as shown in FIG. 2, a medium feeding port 22 of a medium supply unit 20, which will be described later, in the apparatus main body 12 is in an opened state with respect to an upper side of the printer 10. For this reason, the medium supply unit 20 can feed the medium which is placed on the medium support surface 14*a* to a feeding path which will be described later. In addition, the medium feeding port 22 is provided with a pair of medium guides 24 which are configured to be able to move so as to approach and separate from each other in a width direction (X axis direction) of the printer 10. The pair of medium guides 24 constrain opposite ends of the medium in the width direction and defines a position of the medium in the width direction of the apparatus.

In addition, the operation unit 18 (see FIG. 2) includes a power button, a print setting button, and the like for operating the printer 10. When the sheet supply cover 14 is in the opened state with respect to the apparatus main body 12, a user can access the operation unit 18 and operate the printer 10.

Furthermore, the discharge port cover 16 is provided at the front surface of the apparatus main body 12. The discharge port cover 16 is attached to the front surface of the apparatus so as to be able to turn such that a discharge port 26 provided in the front surface of the apparatus main body 12 can be opened and closed. The discharge port cover 16 can be in an opened state (see FIG. 2) and a closed state (see FIG. 1) with respect to the apparatus main body 12.

The discharge port cover 16 in the opened state with respect to the apparatus main body 12 allows the medium, on which recording is performed, to be discharged from a discharge unit 28, which will be described later, in the apparatus main body 12 to the front side of the printer 10 via the discharge port 26.

Concerning Medium Feeding Path

Next, a further detailed description will be given of components on the medium feeding path in the printer 10 with reference to FIG. 3. In FIG. 3, the right side of the paper (the rear surface side of the apparatus) is an upstream side of the feeding path, and the left side of the paper (the front surface side of the apparatus) is a downstream side of the feeding path.

On the upstream side of the feeding path, the medium supply unit 20 for feeding the medium from the medium support surface 14*a* of the sheet supply cover 14 in the opened state with respect to the apparatus main body 12 to the downstream side of the feeding path is provided. The medium supply unit 20 includes the medium feeding port 22, the pair of medium guides 24 provided at the medium feeding port, a medium support unit 30 for supporting at least a part of the medium which is loaded from the medium feeding port 22, and a feeding roller 32 provided at a position at which the feeding roller 32 faces the medium support unit 30, and a returning lever 34. In addition, the sheet supply cover 14 and the medium support unit 30 configure a support mechanism 36 for supporting the medium. The support mechanism 36 supports the medium in an inclined state.

The medium support unit 30 is formed in a downwardly inclined state toward the side of the −Y direction in FIG. 3. In addition, the feeding roller 32 is configured to be able to swing in a direction in which the feeding roller 32 approaches and separates from the medium placed on the medium support unit 30. The feeding roller 32 is brought into contact with the uppermost medium placed on the medium support unit 30 when displaced in a direction in which the feeding roller 32 approaches the medium support unit 30, and feeds the uppermost medium to the downstream side of the feeding path. At this time, the subsequent media are returned to the medium support unit 30 by the returning lever 34 to prevent the following media from being accidentally fed to the downstream side of the feeding path.

A transport unit 38 is provided on the downstream side of the medium supply unit 20. The transport unit 38 is provided with a transport drive roller 40 and a transport driven roller 42. The transport drive roller 40 is integrally attached to a transport roller shaft 44 and is rotated along with the transport roller shaft 44 by a drive source which is not shown in the drawing. The transport unit 38 nips the medium fed from the medium supply unit 20 between the transport drive roller 40 and the transport driven roller 42 and transports the medium to the downstream side in the transport direction. A recording unit 46 is provided on the downstream side of the transport unit 38.

The recording unit 46 is provided with a carriage 48, a recording head 50 which is provided at the bottom of the carriage, and a lower side guide member, namely a platen 52 as a support unit which faces the recording head and supports the medium. The recording head 50 faces the medium supported by the platen 52. The carriage 48 is driven to reciprocate in a main scanning direction (in a paper front-back surface direction, namely the X axis direction in FIG. 3) by a drive motor (not shown), which is controlled by a control unit (not shown) provided in the apparatus main body 12. In addition, the platen 52 defines a distance (gap) between a recording surface of the medium and a head surface of the recording head 50 by supporting the medium from the lower side.

The discharge unit 28 is provided on the downstream side of the recording unit 46 in the transport direction. The discharge unit 28 is provided with a discharge roller 54. The medium, on which the recording unit 46 performs recording, is discharged by the discharge roller 54 from the discharge port 26 provided in the front surface of the apparatus toward the front side of the apparatus.

In addition, the control unit is provided in the apparatus main body 12 though not shown in the drawing. The control unit controls the transport unit 38, the recording unit 46, and the discharge unit 28 based on a command input by the user to the operation unit 18. In addition, the control unit controls the carriage 48 to perform cleaning by forcibly ejecting or suctioning ink from nozzles in the recording head 50 in a maintenance region which is provided in a moving region of the carriage 48.

Concerning Accommodation Chamber and Waste Liquid Cartridge

Referring to FIGS. 1 and 3, a battery 56 which can be attached to and detached from the apparatus main body 12 is provided at an upper portion on the rear surface side (the side of the +Y axis direction in FIG. 3) of the apparatus main body 12. Furthermore, an accommodation chamber 58 is provided below the battery 56 (on the side of the −Z axis direction in FIG. 3) in the apparatus main body 12, and a waste liquid cartridge 60 as the "cartridge" is attached thereto so as to be able to be attached to and detached from the accommodation chamber 58. Hereinafter, a detailed description will be given of the accommodation chamber 58, the waste liquid cartridge 60, and the cover 64 with reference to FIGS. 4 to 8B.

Referring to FIG. 4, a cover 64 which can be attached to and detached from the apparatus main body 12 is provided at a lower surface 62 of the apparatus main body 12. If the cover 64 is detached from the lower surface 62 of the apparatus main body 12, the waste liquid cartridge 60 accommodated in the accommodation chamber 58 is exposed as shown in FIG. 5. FIG. 5 shows a state where the waste liquid cartridge 60 is in the first position, which will be described later, in the accommodation chamber 58.

Next, a description will be given of the accommodation chamber 58 with reference to FIG. 6. The accommodation chamber 58 is provided on a lower surface 62 of the apparatus main body 12 on the rear surface side (on the side of the +Y direction in FIG. 3) of the apparatus. The accommodation chamber 58 opens toward the lower side of the apparatus main body 12, namely toward the side of the −Z direction in FIG. 6 in a state where the cover 64 is detached from the apparatus main body 12.

The accommodation chamber 58 is formed as a concave portion of the apparatus main body 12. The accommodation chamber 58 is formed to have a rectangular shape in the embodiment. The length of the accommodation chamber 58 in the Y axis direction in FIG. 6 is set to be a size corresponding to the length of the waste liquid cartridge 60, which will be described later, in the Y axis direction. In contrast, the length L1 (see FIG. 6) of the accommodation chamber 58 in the X axis direction in FIG. 6 is set to be longer than the length L2 (see FIG. 7) of the waste liquid cartridge 60 in the X axis direction. The waste liquid cartridge 60 can slide between a first position (see FIG. 6) which will be described later and a second position (see FIG. 9A) which will be described later in the accommodation chamber 58.

In addition, a needle 66 as a "connected unit", a connection terminal 68, and a connection pin which is not shown in the drawing are provided in a wall surface of the accommodation chamber 58 on the side of the −X direction in FIG. 6. The needle 66 includes a liquid flow path (not shown) formed therein, and the liquid flow path extends toward the inside of the apparatus main body 12. The liquid flow path is formed as a flow path for collecting waste ink, which is discharged when cleaning is performed on the carriage 48, to the waste liquid cartridge 60. In addition, the needle 66 is biased from the side of the −X direction toward the side of the +X direction in FIG. 6 by a bias mechanism which is not shown in the drawing.

In addition, the connection terminal 68 is electrically connected to an information storage unit 70 (FIG. 7), which is provided in the waste liquid cartridge 60, when the waste liquid cartridge 60 is at the first position in the accommodation chamber 58. Information on the amount of collected ink in the waste liquid cartridge 60, which is detected by the information storage unit 70, is transmitted to the control unit (not shown) via the connection terminal 68. The control unit provides information about replacement of the waste liquid cartridge 60 to the user based on the information transmitted from the information storage unit 70.

In addition, a pair of restricting units 72 are provided in wall surfaces 58*a* and 58*a* of the accommodation chamber 58, which face each other with an interval in the Y axis direction in FIG. 6. According to the embodiment, the restricting portions 72 are formed as eave-shaped units which protrude from the wall surfaces 58*a* toward the inside of the accommodation chamber. In addition, a pair of engaging units 74 which extend in the Z axis direction in FIG. 6 are provided in the wall surfaces 58*a* and 58*a*. Furthermore, cover engagement units 76 are provided at opposite ends in the X axis direction of the wall surfaces 58*a* of the accommodation chamber 58 on the rear surface side of the apparatus main body 12, namely on the side of the +Y axis direction in FIG. 6.

Next, a description will be given of the waste liquid cartridge 60 with reference to FIG. 7. In the embodiment, the waste liquid cartridge 60 is configured to have a substantially cuboid shape, and an ink absorber 77 (see FIG. 9B) such as a porous material is provided therein.

At an end of the waste liquid cartridge 60 on the side of the −X direction in FIG. 7, a liquid flow port 78, the information storage unit 70, and a guide hole 80 are provided. The liquid flow port 78 is connected to the needle 66 when the waste liquid cartridge 60 is at the first position (see FIG. 5) in the accommodation chamber 58. In addition, the liquid flow path provided at the needle 66 can communicate with the waste liquid cartridge 60, and the waste ink can be made to flow from the inside of the apparatus main body 12 to the waste liquid cartridge 60 via the liquid flow path.

The information storage unit 70 maintains data relating to the amount of ink collected in the waste liquid cartridge 60, and transmits the information relating to the amount of collected ink to the control unit (not shown) via the connection terminal 68. The guide hole 80 receives the connection pin (not shown) provided at the accommodation chamber 58 and positions the waste liquid cartridge 60 with respect to the accommodation chamber 58 when the waste liquid cartridge 60 is at the first position (see FIG. 5) in the accommodation chamber 58.

In addition, the waste liquid cartridge 60 includes a guide groove 82 and a restricted unit 84 respectively provided at the opposite sides thereof in the Y axis direction in FIG. 7. The guide groove 82 is formed as a groove which extends in the Z axis direction in FIG. 7 so as to penetrate through the side of the waste liquid cartridge 60 in the Y axis direction. The restricted unit 84 is configured as a groove which communicates with the guide groove 82 on the side of the −Z direction and extends in the +X direction. Therefore, the guide groove 82 and the restricted unit 84 are formed as a crank-shaped groove when the side of the waste liquid cartridge 60 in the Y axis direction is viewed from the Y axis direction.

In addition, the width of the guide groove 82 in the X axis direction in FIG. 7 is set to such a size that the restricting unit 72 can be received. In addition, the size of the restricted unit 84 in the Z axis direction in FIG. 7 is set to such a size that the restricting unit 72 can be received. Therefore, the restricted unit 84 restricts movement of the restricting unit 72 in the Z axis direction and allows movement in the X axis direction in FIG. 7 when receiving the restricting unit 72.

In addition, the waste liquid cartridge 60 is provided with an arm 86 at a side thereof in the Y axis direction in FIG. 7. The arm 86 protrudes from the waste liquid cartridge 60 in the X axis direction in FIG. 7 and extends in the X axis direction. An end 86*a* of the arm 86 on the side of the +X direction in FIG. 7 is configured as a free end. Therefore, the end 86*a* on the side of the +X direction can be bent in the Y axis direction (see FIG. 10B).

At the end 86*a* of the arm 86 on the side of the +X direction, an engaged unit 88 and an engagement release unit 90 are provided. The engaged unit 88 is engaged with the engaging unit 74 provided in the accommodation chamber 58 such that the engagement can be released when the waste liquid cartridge 60 is attached to the accommodation chamber 58 and is made to slide from the second position (see FIG. 9A) to the first position (see FIG. 10A) which will be described later.

The engagement release unit 90 is provided so as to project on the side of the −Z direction from the end 86*a* on the side of the +X direction. The engagement between the engaging unit 74 and the engaged unit 88 is released by pressing the engagement release unit 90 toward the side of the main body of the waste liquid cartridge 60 and bending the arm 86 toward the side of the main body of the waste liquid cartridge 60.

Next, a description will be given of the cover 64 with reference to FIGS. 8A and 8B. The cover 64 is configured to have a plate shape. At an end of the cover 64 on the side of the −Y direction in FIG. 8A, a plurality of crawling units 92 are provided. In addition, hooks 94 are provided at opposite ends in the X axis direction of the end on the side of the +Y direction.

As shown in FIG. 8B, a stopper unit 96 is formed at the cover 64 on a side on which the cover 64 faces the accommodation chamber 58. The stopper unit 96 is formed at the end on the side of the −X direction in FIG. 8B. The length L3 of the stopper unit 96 in the X axis direction is set to be equal to a length acquired by subtracting the length L2 of the waste liquid cartridge 60 in the X axis direction from the length L1 of the accommodation chamber 58 in the X axis direction. In addition, a C surface or an R-shaped guide surface 96*a* is formed at an end of the stopper unit 96 on the side of the +X direction.

Concerning Attachment and Detachment of Waste Liquid Cartridge to and from Accommodation Chamber Next, a description will be given of attachment and detachment of the waste liquid cartridge 60 to and from the accommodation chamber 58 with reference to FIGS. 9A to 11B.

As shown in FIG. 9A, the waste liquid cartridge 60 is attached to the accommodation chamber 58. At this time, the waste liquid cartridge 60 is attached to the accommodation chamber 58 by matching the position of the guide groove 82 of the waste liquid cartridge 60 with respect to the restricting unit 72 of the accommodation chamber 58 and moving the waste liquid cartridge 60 in the +Z direction in FIG. 9A. Since the guide groove 82 extending in the Z axis direction in FIG. 9A receives the restricting unit 72 when the waste liquid cartridge 60 is attached to the accommodation chamber 58, the movement of the waste liquid cartridge 60 in the X axis direction in FIG. 9A is restricted, and only the movement in the Z axis direction is allowed. The position of the waste liquid cartridge 60 in the X axis direction with respect to the accommodation chamber 58 in this state is referred to as the second position.

As shown in FIG. 9B, the needle 66 in the accommodation chamber 58 is not connected to the liquid flow port 78 of the waste liquid cartridge 60 at the second position. Similarly, the connection terminal 68 is also not connected to the information storage unit 70 of the waste liquid cartridge 60.

In addition, the first position is a position in a state where the needle 66 in the accommodation chamber 58 is connected to the liquid flow port 78 of the waste liquid cartridge 60 as shown in FIG. 11A. In this state, a liquid flow which connects between the inside of the apparatus main body 12 and the waste liquid cartridge 60 for collecting the waste ink is formed. Similarly, the connection terminal 68 is connected to the information storage unit 70 of the waste liquid cartridge 60.

Next, the waste liquid cartridge 60 at the second position (see FIG. 9A) as shown in FIG. 10A is made to slide toward the first position (see FIG. 5) in the −X direction in FIG. 10A. At the second position, the restricting unit 72 of the accommodation chamber 58 is positioned at the end of the guide groove 82 on the side of the −Z direction. Since the restricted unit 84 extends from the guide groove 82 toward the side of the +X direction at the end of the waste liquid cartridge 60 on the side of the −Z direction, it is possible to receive the restricting unit 72 by the restricted unit 84 when the waste liquid cartridge 60 is made to slide in the −X direction. For this reason, the movement of the waste liquid cartridge 60 in the Z axis direction is restricted when made to slide from the second position (see FIG. 9A) to the first position (see FIG. 5) since the restricting unit 72 is engaged with the restricted unit 84. In addition, the weight of the waste liquid cartridge 60 is not applied to the cover 64 when the cover 64 is closed with respect to the apparatus main body 12 since the weight of the waste liquid cartridge 60 is applied to the restricting unit 72 and thus the apparatus main body 12.

Since the restricting unit 72 is engaged with the restricted unit 84 by the waste liquid cartridge 60 sliding from the second position (see FIG. 9A) to the first position (see FIG. 5), it is possible to restrict attachment and detachment of the waste liquid cartridge 60 to and from the accommodation chamber 58. That is, it is possible to attach and detach the waste liquid cartridge 60 to and from the accommodation chamber 58 only at the second position (see FIG. 9A) and to thereby prevent the waste liquid cartridge 60 from accidentally dropping off from the apparatus main body 12.

If the waste liquid cartridge 60 is made to slide in the X axis direction in FIG. 10A, the engaged unit 88 of the arm 86 is brought into contact with the engaging unit 74 provided in the accommodation chamber 58 as shown in FIG. 10B. Then, if the waste liquid cartridge 60 is continuously made to slide in the −X direction, the engaged unit 88 and thus the arm 86 are bent on the side of the waste liquid cartridge 60 (the side of the +Y direction in FIG. 10B) by the engaging unit 74.

If the engaged unit 88 passes over the engaging unit 74, the bent state of the arm 86 is released, and the arm 86 is displaced on the side of the −Y direction. Then, the engagement state is established between the engaging unit 74 and the engaged unit 88. At this time, an engagement sound, such as a "click" sound, or a clicking feeling is generated.

Therefore, since at least one of the engagement sound or the clicking sensation is generated when the engaged unit 88 is engaged with the engaging unit 74 while the waste liquid cartridge 60 is made to slide from the second position (see FIG. 9A) to the first position (see FIG. 10A), it is possible for a user to easily recognize that the waste liquid cartridge 60 has been set at a predetermined position.

In addition, it is possible to displace the waste liquid cartridge 60 from the second position (see FIG. 9A) to the first position by causing the waste liquid cartridge 60 to slide toward the side in the −X direction in FIG. 10A in the accommodation chamber 58 as shown in FIG. 10A.

Since the needle 66 is biased in a direction (the +X direction in FIG. 10A) from the first position (see FIG. 10A) toward the second position (see FIG. 9A), the needle 66 pressurizes the liquid flow port 78 of the waste liquid cartridge 60, and it is possible to enhance close contact between the liquid flow port 78 and the needle 66 when the waste liquid cartridge 60 is at the first position (see FIG. 10A) in the accommodation chamber 58. Accordingly, it is possible to suppress leakage of the waste ink from between the liquid flow port 78 and the needle 66.

In addition, a sliding region 98 as the "gap" is formed at the end of the accommodation chamber 58 on the side of the +X direction in the accommodation chamber 58 by the waste liquid cartridge 60 sliding from the second position (see FIG. 9A) to the first position (see FIG. 10A) in the accommodation chamber 58. The length of the sliding region 98 in the X axis direction in FIG. 10A is set to be equal to the length L3 of the stopper unit 96 of the cover 64 in the X axis direction.

Next, the cover 64 is attached to the apparatus main body 12 as shown in FIG. 11B. At this time, the crawling units 92 are inserted into insertion units (not shown) provided in a wall surface 58*a* of the accommodation chamber 58 on the side of the −Y direction in the apparatus main body 12 first.

Then, the cover 64 is turned on the side of the apparatus main body 12 by using the crawling units 92 inserted into the insertion units (not shown) as support points. The guide surface 96*a* of the stopper unit 96 pressurizes, in the −X direction, the end of the waste liquid cartridge 60 on the side of the +X direction even if the waste liquid cartridge 60 slightly deviates from the first position on the side of the +X direction in FIG. 10A at this time. Then, the stopper unit 96 pushes the waste liquid cartridge 60 on the side of the −X direction in FIG. 10A toward the first position. Furthermore, the stopper unit 96 enters the sliding region 98 and restricts the displacement of the waste liquid cartridge 60 in the X axis direction. In addition, the hooks 94 of the cover 64 engage the cover engagement units 76 of the accommodation chamber 58, and the cover 64 is brought into a state where the accommodation chamber 58 is closed.

Since the guide surface 96*a* is provided at a part of the stopper unit 96, which abuts the waste liquid cartridge 60, and the guide surface 96*a* pressurizes the waste liquid cartridge 60 toward the first position even if the waste liquid cartridge 60 slightly deviates from the first position when the cover 64 is closed with respect to the accommodation chamber 58, it is possible to reliably position the cartridge at the first position.

Accordingly, it is possible to attach and detach the waste liquid cartridge 60 to and from the printer 10 by causing the waste liquid cartridge 60 to slide from the second position (see FIG. 9A) to the first position (see FIG. 10A) in the accommodation chamber 58 and to thereby easily replace the waste liquid cartridge 60 in the printer 10. Furthermore, since the waste liquid cartridge 60 is held at the first position even if impact or vibration due to dropping-off of the printer 10 is applied by the stopper unit 96 of the cover 64 entering the sliding region 98 where the waste liquid cartridge slides from the first position (see FIG. 10A) to the side of the second position (see FIG. 9A), it is possible to prevent the waste liquid cartridge 60 from dropping off from the printer 10.

Next, a description will be given of a method of detaching the waste liquid cartridge 60 at the first position from the accommodation chamber 58. The engagement between the hooks 94 of the cover 64 and the cover engagement units 76 of the accommodation chamber 58 is released. The cover 64 is turned toward the outside of the apparatus main body 12 by using the crawling units 92, which are inserted into the insertion units (not shown), as support points, and the cover 64 is detached from the apparatus main body 12.

Then, the engagement release unit 90 of the arm 86 of the waste liquid cartridge 60 is pressed into the side of the waste liquid cartridge 60, the arm 86 is bent toward the side of the waste liquid cartridge 60, and the engagement between the engaging unit 74 and the engaged unit 88 is released. If the engagement between the engaging unit 74 and the engaged unit 88 is released, the waste liquid cartridge 60 is biased on the side of the +X direction in FIG. 10A by the bias force acting on the needle 66 and is made to slide from the first position (see FIG. 10A) toward the second position (see FIG. 9A).

When the waste liquid cartridge 60 is at the second position (see FIG. 9A), it is possible to displace the waste liquid cartridge 60 in the −Z direction in FIG. 10A and detach the waste liquid cartridge 60 from the accommodation chamber 58.

Other Modification Examples (1) Although the cartridge is configured as the waste liquid cartridge 60 in the embodiment, the cartridge may be configured as an ink supply cartridge for supplying ink to the recording head 50 instead of the above configuration.

(2) Although the restricting unit 72 of the accommodation chamber 58 is configured to be the eave-shaped unit, the restricting unit 72 may be configured as a protrusion unit or a projecting unit instead of the above configuration.

(3) Although the "connected unit" which is connected to the liquid flow port 78 of the waste liquid cartridge 60 is configured as the needle 66, another configuration is applicable in which the liquid flow port 78 and the connected unit are in close contact with each other by configuring the connection portion therebetween in a mesh shape to form the liquid flow path, instead of the above configuration.

(4) although the cover 64 is configured to be able to be attached to and detached from the apparatus main body 12 by the hooks 94 in the embodiment, another configuration is also applicable in which a turning shaft is provided at the apparatus main body 12 such that the cover 64 is opened and closed by being turned with respect to the apparatus main body 12, instead of the above configuration.

(5) Although the waste liquid cartridge 60 is attached to the accommodation chamber 58 and the sliding region 98 is formed by displacing the waste liquid cartridge 60 from the second position (see FIG. 9A) to the first position in the accommodation chamber 58 according to the configuration of the embodiment, another configuration is also applicable in which a gap is formed in the accommodation chamber 58 when the waste liquid cartridge 60 is attached to the accommodation chamber 58 instead of the above configuration.

According to the configuration, a gap is formed in the accommodation chamber 58 when the waste liquid cartridge 60 is attached to the accommodation chamber 58, and the stopper unit 96 provided at the cover 64 enters the gap if the cover 64 is closed in this state, and therefore, it is possible to restrict the displacement of the waste liquid cartridge 60 in the accommodation chamber 58. Accordingly, it is possible to further restrict the displacement of the waste liquid cartridge 60 in the accommodation chamber 58 in this configuration as compared with a configuration in which the stopper unit 96 is not allowed to enter the gap, and therefore, it is possible to suppress accidental displacement of the waste liquid cartridge 60 into the gap, namely in the X axis direction in FIG. 10A and to thereby reduce or suppress the concern in that the waste liquid cartridge 60 drops off from the accommodation chamber 58.

Second Embodiment

Hereinafter, a description will be given of a second embodiment of the invention with reference to FIGS. 12 to 24.

Figure 12:
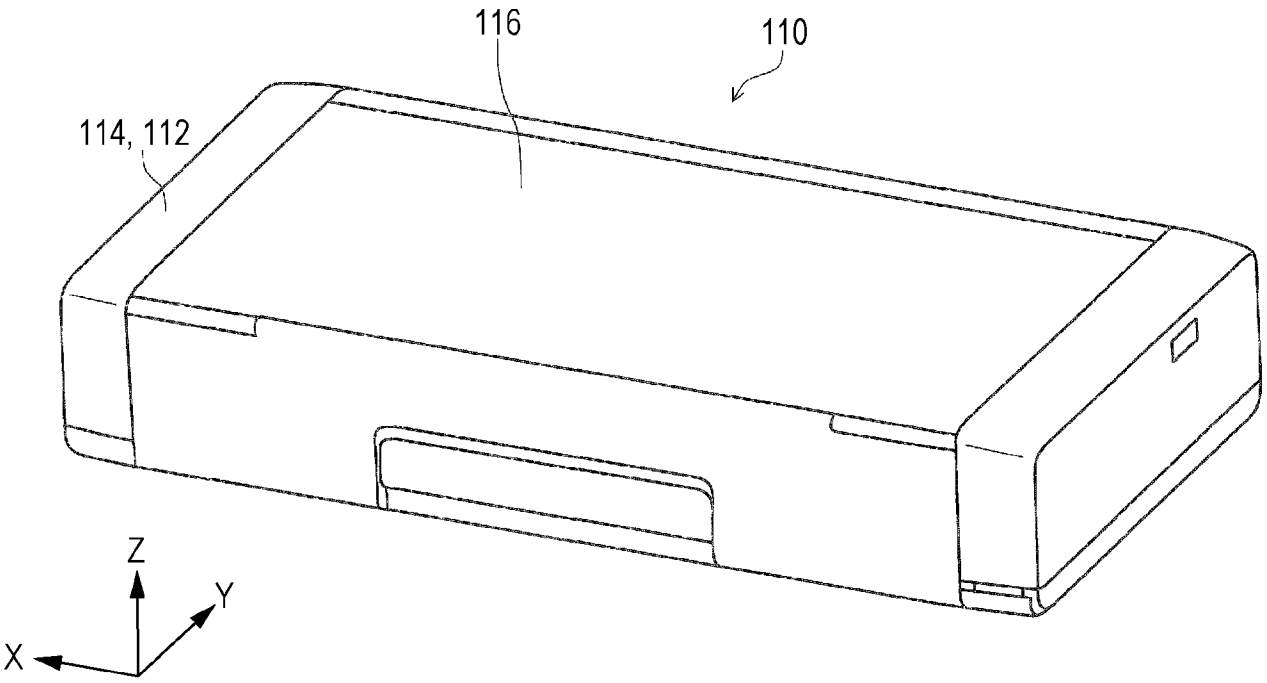
FIG. 12 is a perspective view of an appearance in a state where the cover is closed in the printer according to the invention.
Figure 13:
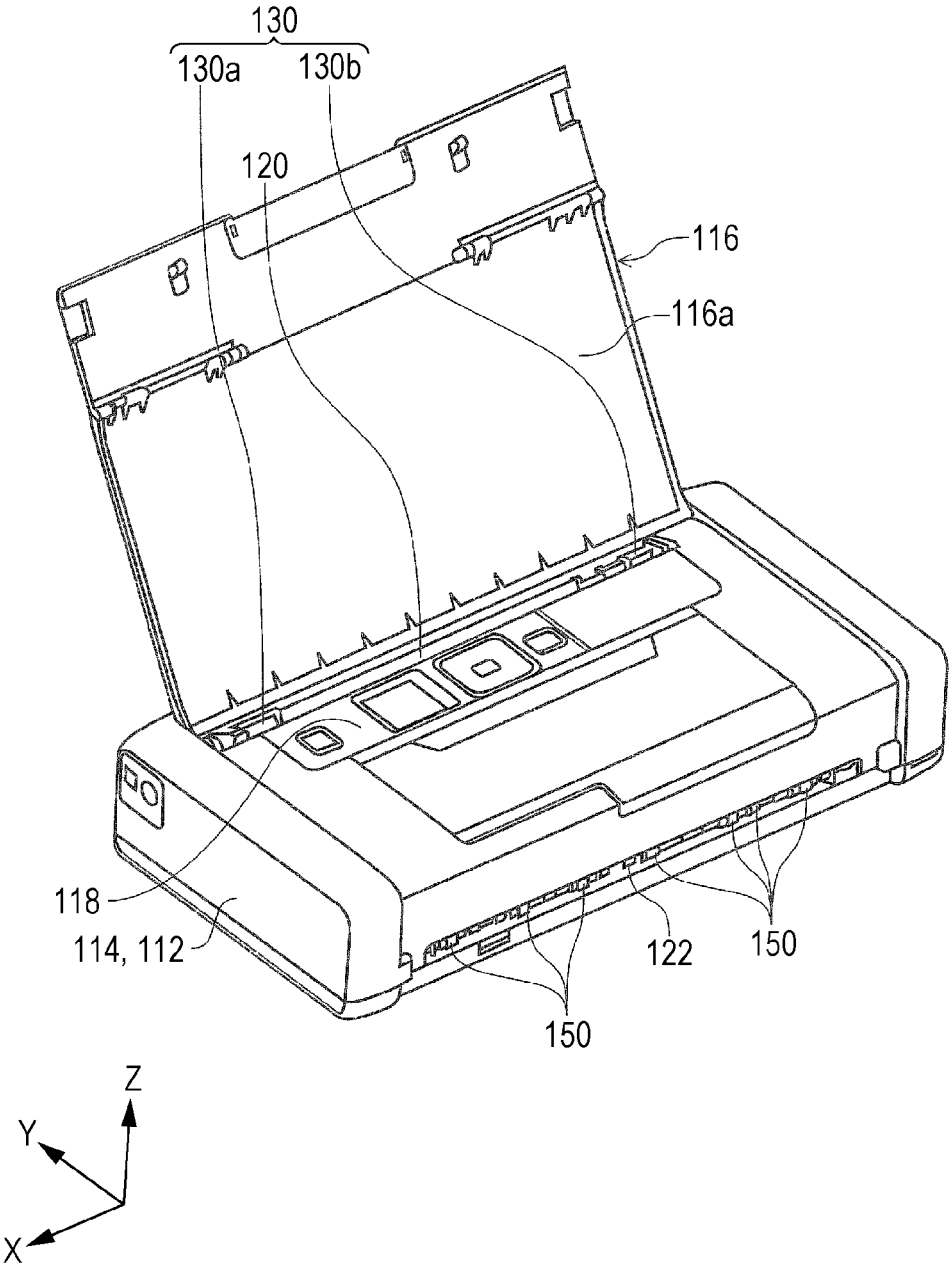
FIG. 13 is a perspective view of an appearance in a state where the cover is opened in the printer according to the invention.
Figure 14:
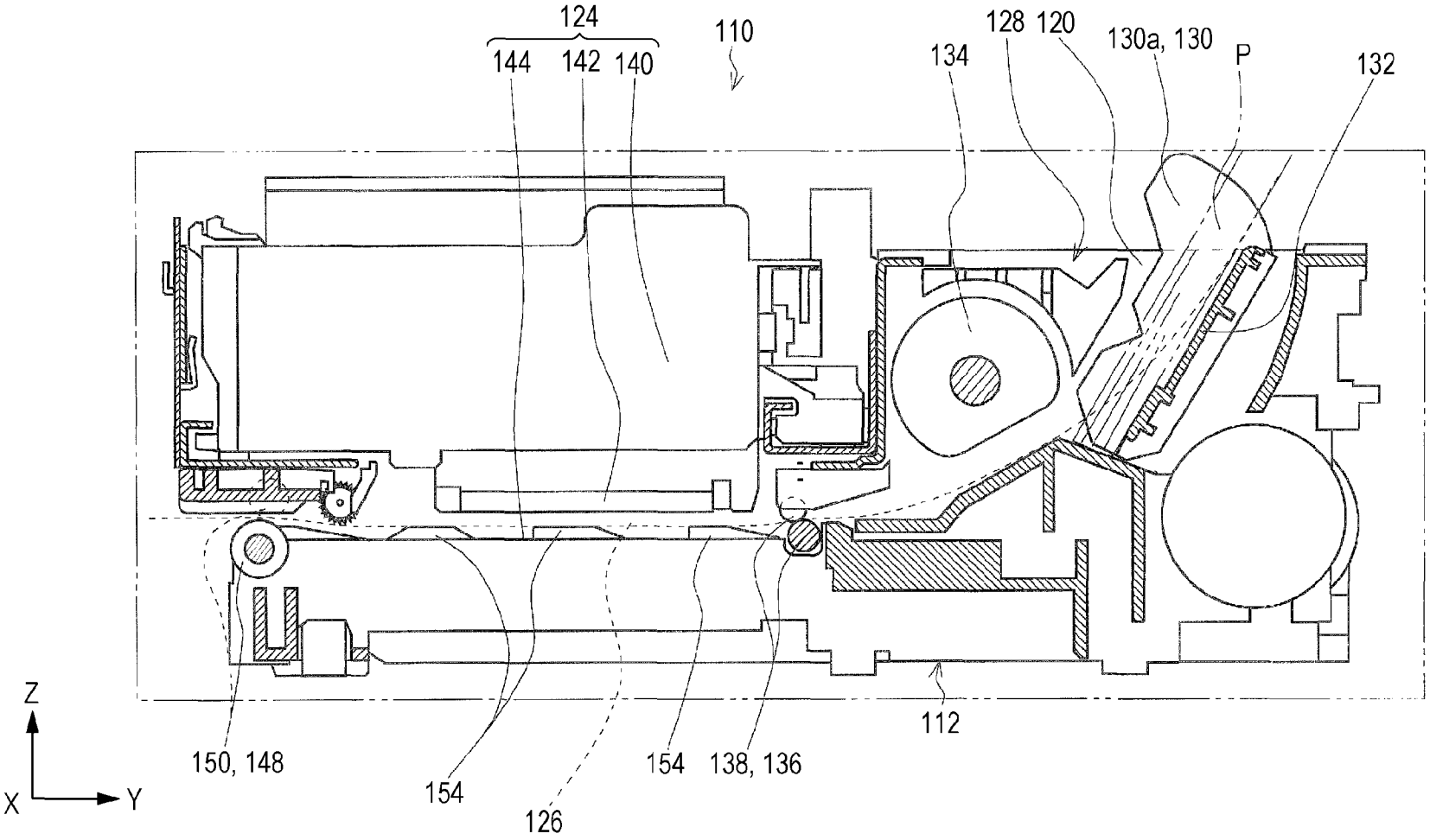
FIG. 14 is a side cross-sectional view showing a medium transport path in the printer according to the invention.
Figure 15:
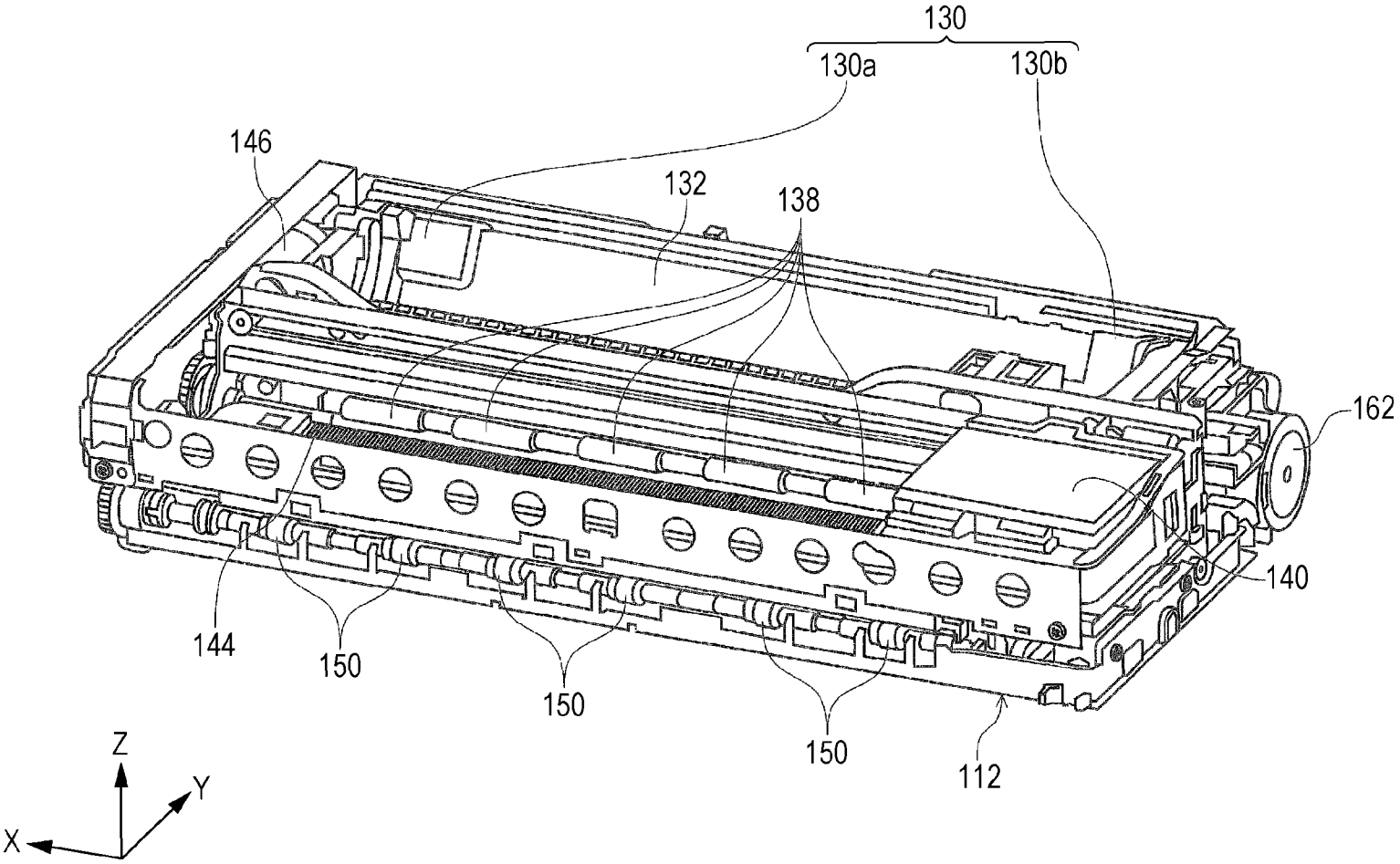
FIG. 15 is a perspective view of an appearance of an apparatus main body of the printer according to the invention.
Figure 16:
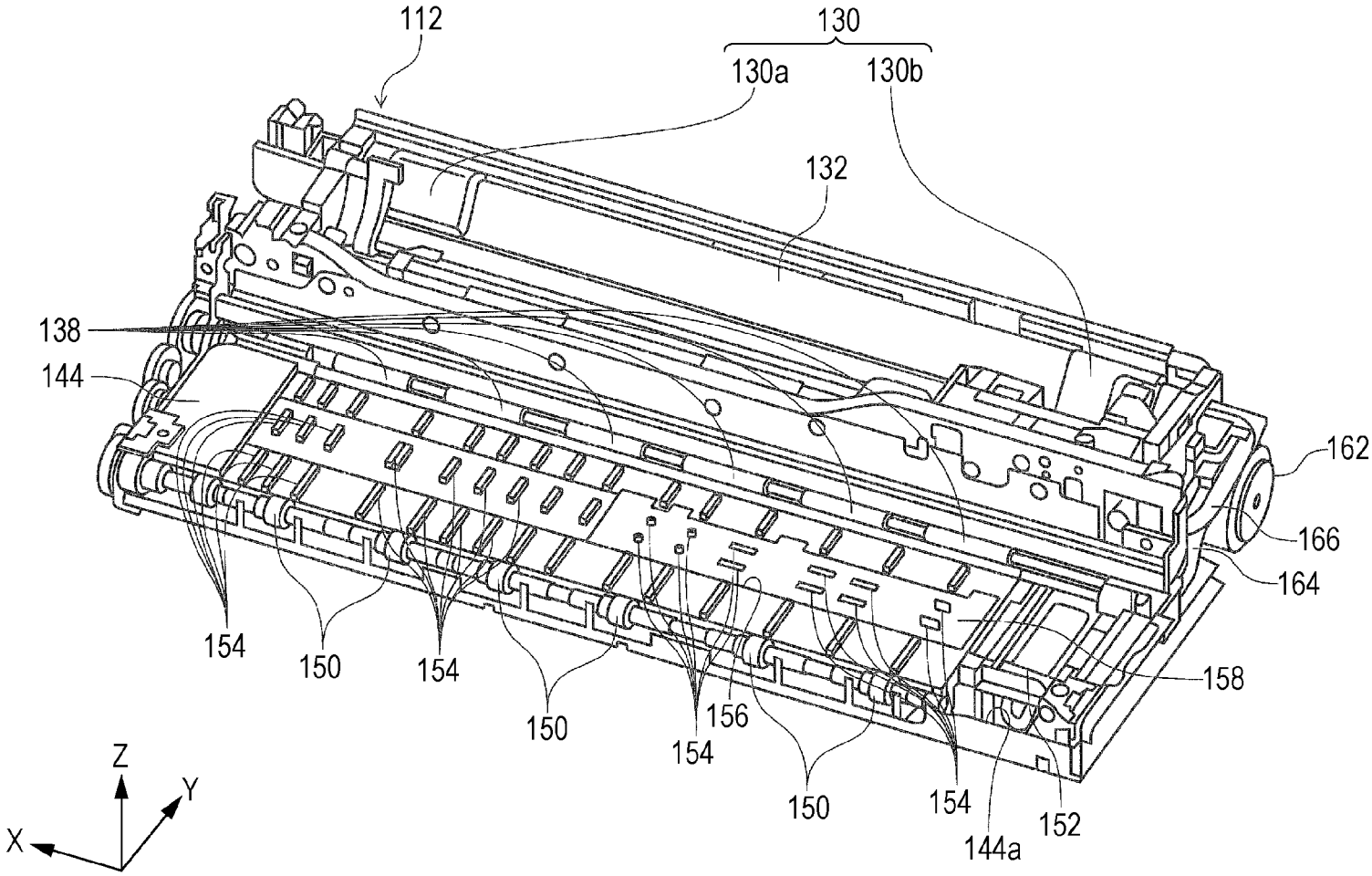
FIG. 16 is a perspective view showing a platen and a cap which are provided in the apparatus main body.
Figure 17:
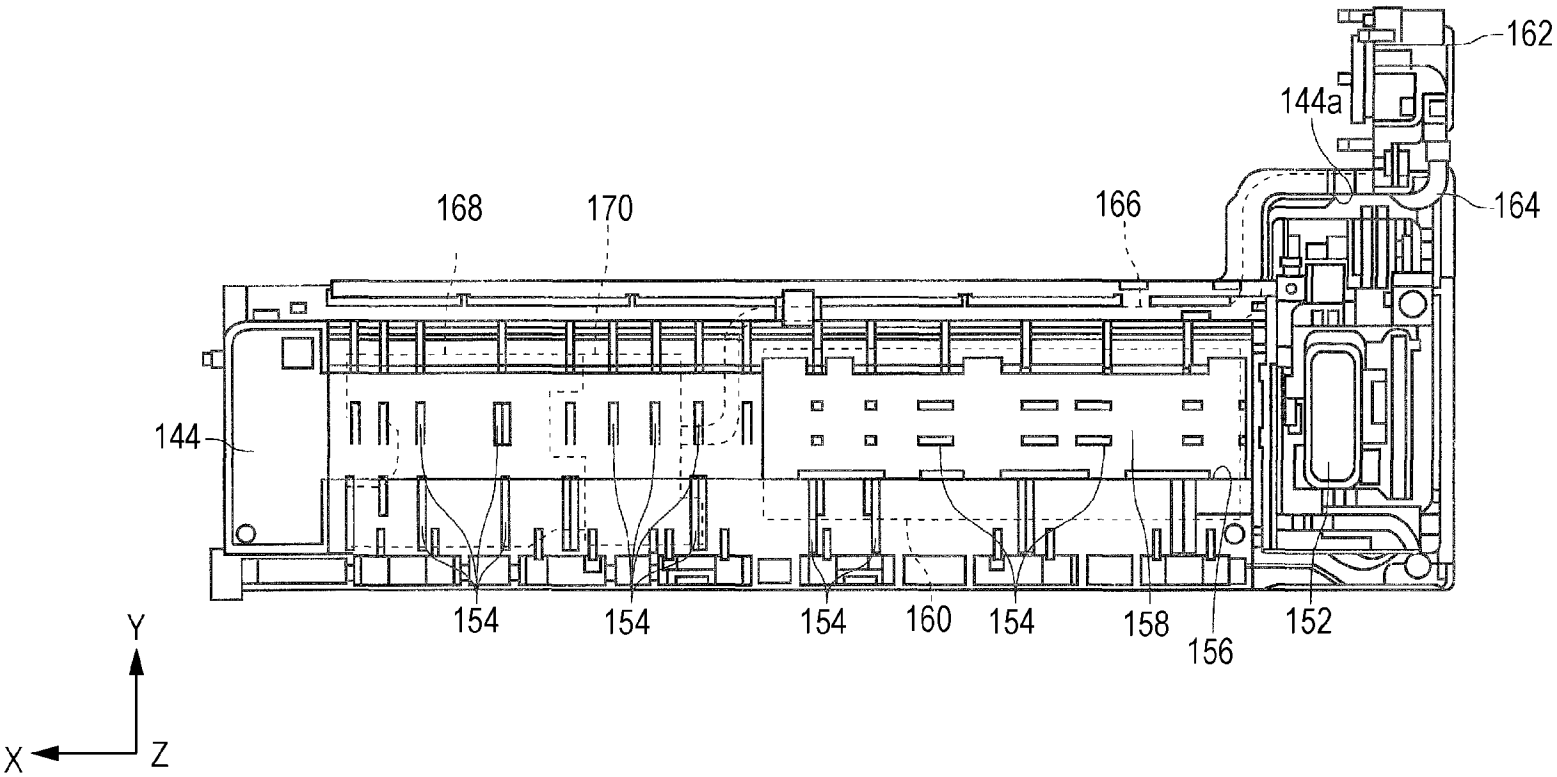
FIG. 17 is a planar view of the platen and the cap when viewed from an upper side.

FIG. 12 is a perspective view of an appearance in a state where the cover is closed in the printer according to the invention, FIG. 13 is a perspective view of an appearance in a state where the cover is opened in the printer according to the invention, FIG. 14 is a side cross-sectional view showing a medium transport path in the printer according to the invention, FIG. 15 is a perspective view of an appearance of the apparatus main body of the printer according to the invention, FIG. 16 is a perspective view showing a platen and a cap provided in the apparatus main body, and FIG. 17 is a planar view of the platen and the cap when viewed from the upper side.

Figure 18:
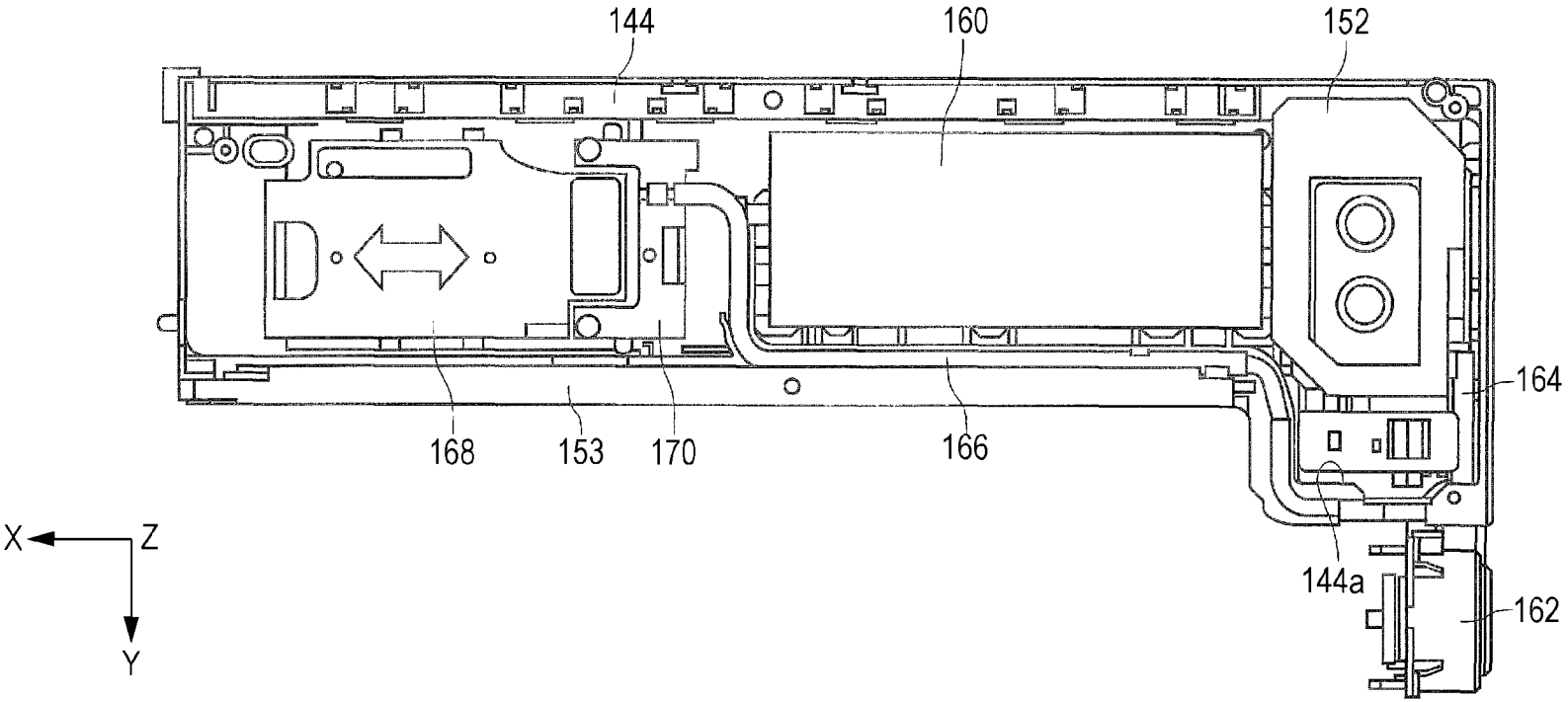
FIG. 18 is a planar view of the platen and the cap when viewed from a lower side.
Figure 19:
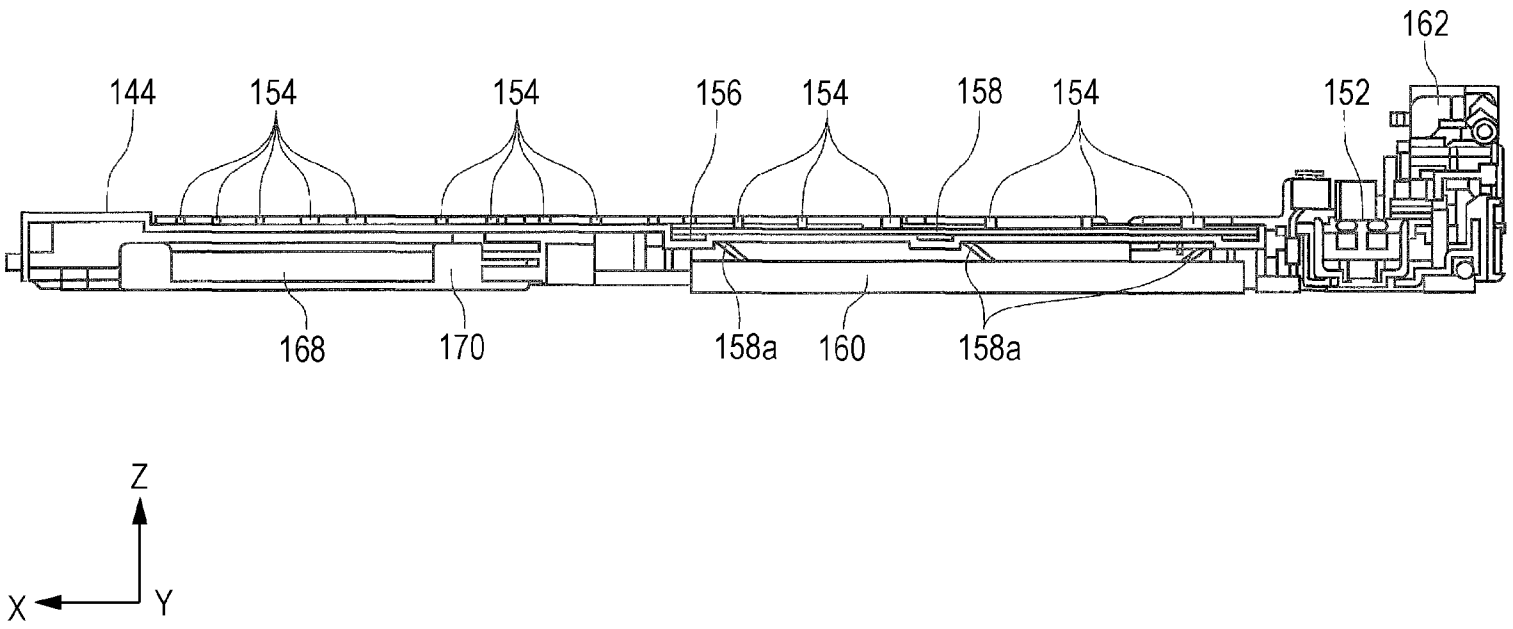
FIG. 19 is a side cross-sectional view of the platen and the cap.
Figure 20:
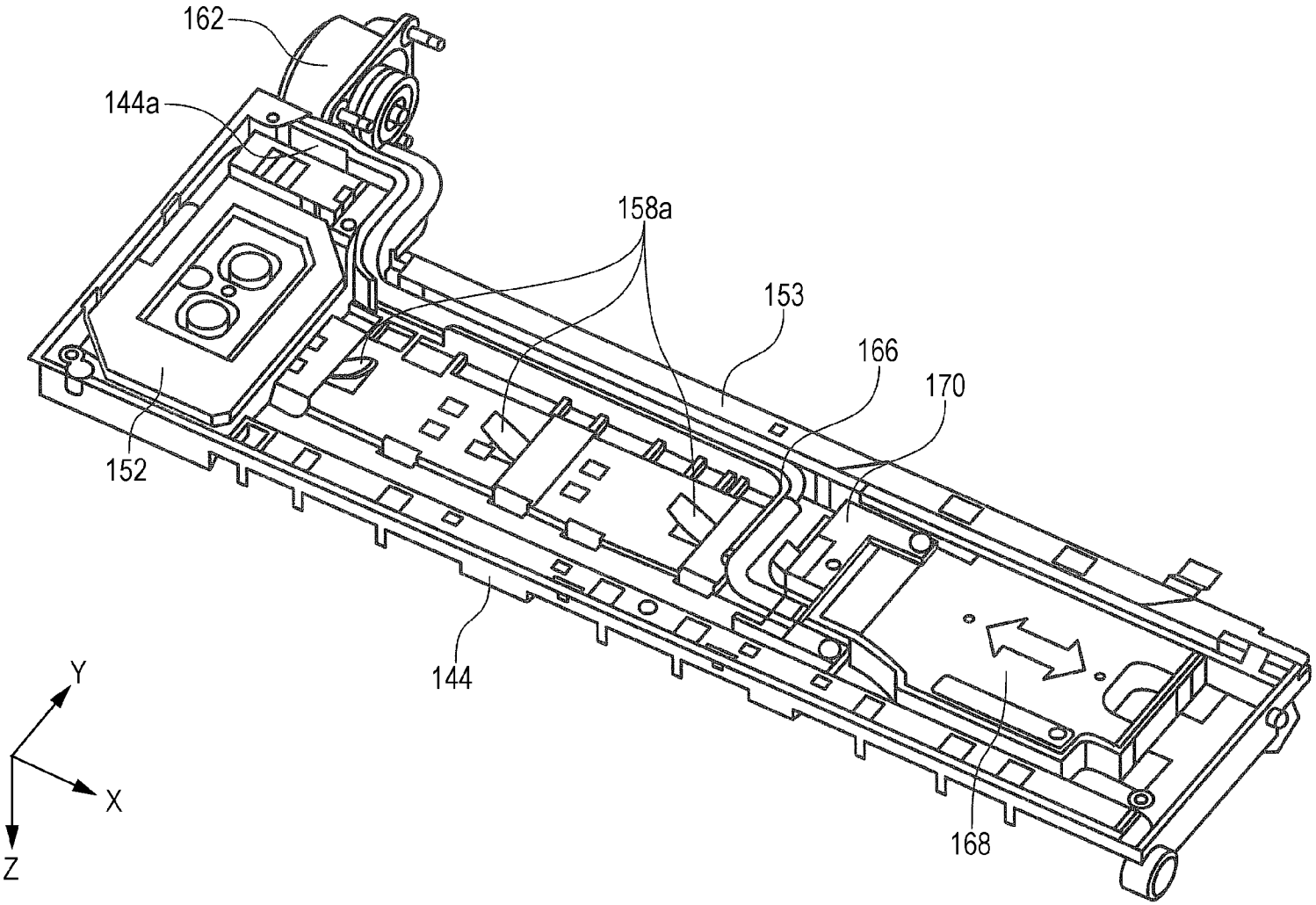
FIG. 20 is a perspective view of the platen and the cap when viewed from the lower side.
Figure 21:
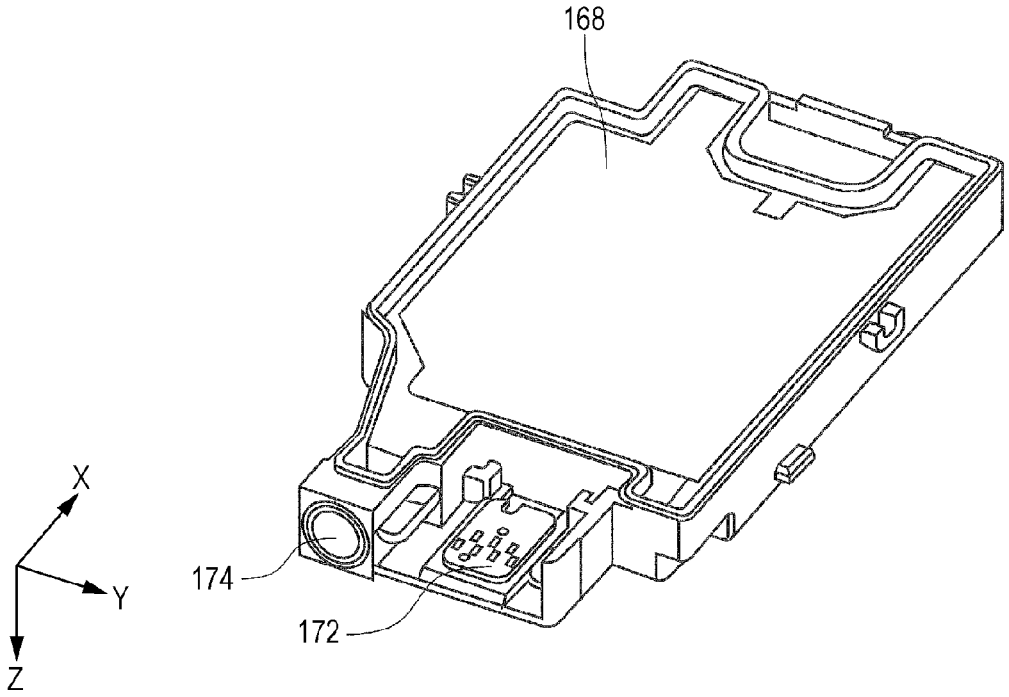
FIG. 21 is a perspective view of a waste liquid cartridge.
Figure 22:
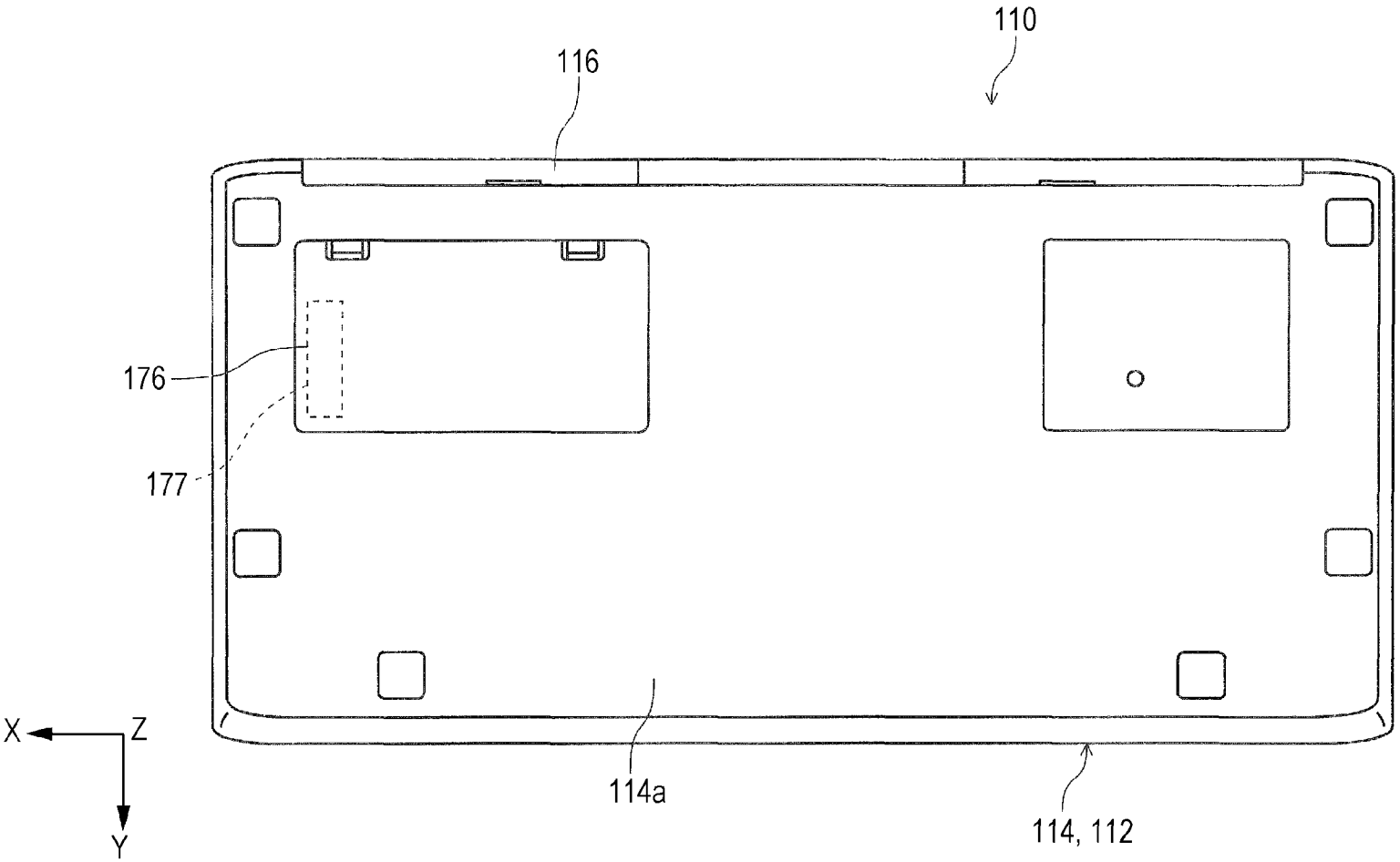
FIG. 22 is a planar view of the printer when viewed from the lower side in a state where a cover is attached to a waste liquid cartridge accommodation unit.
Figure 23:
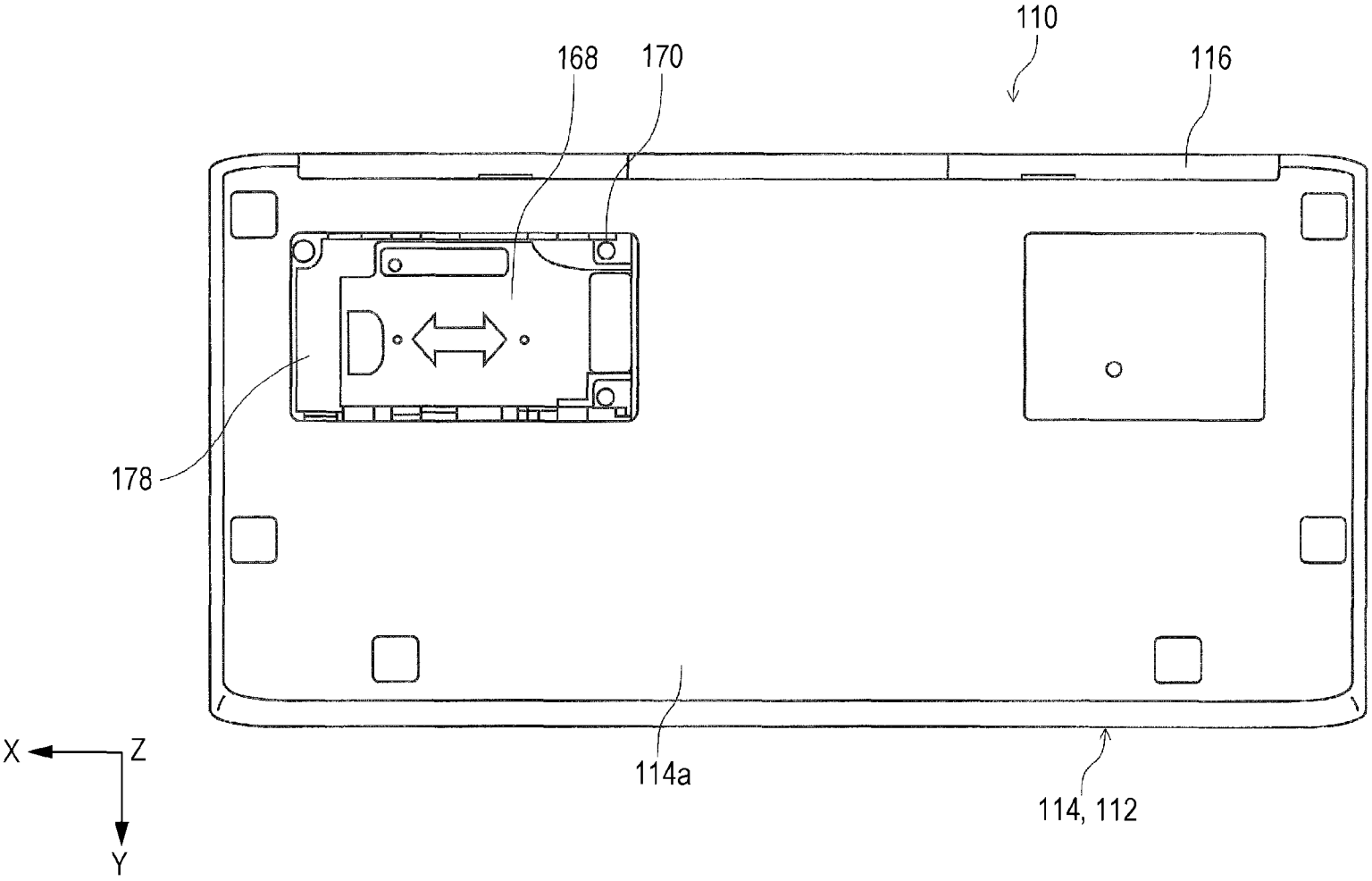
FIG. 23 is a planar view of the printer when viewed from the lower side in a state where the waste liquid cartridge is accommodated in the waste liquid cartridge accommodation unit.
Figure 24:
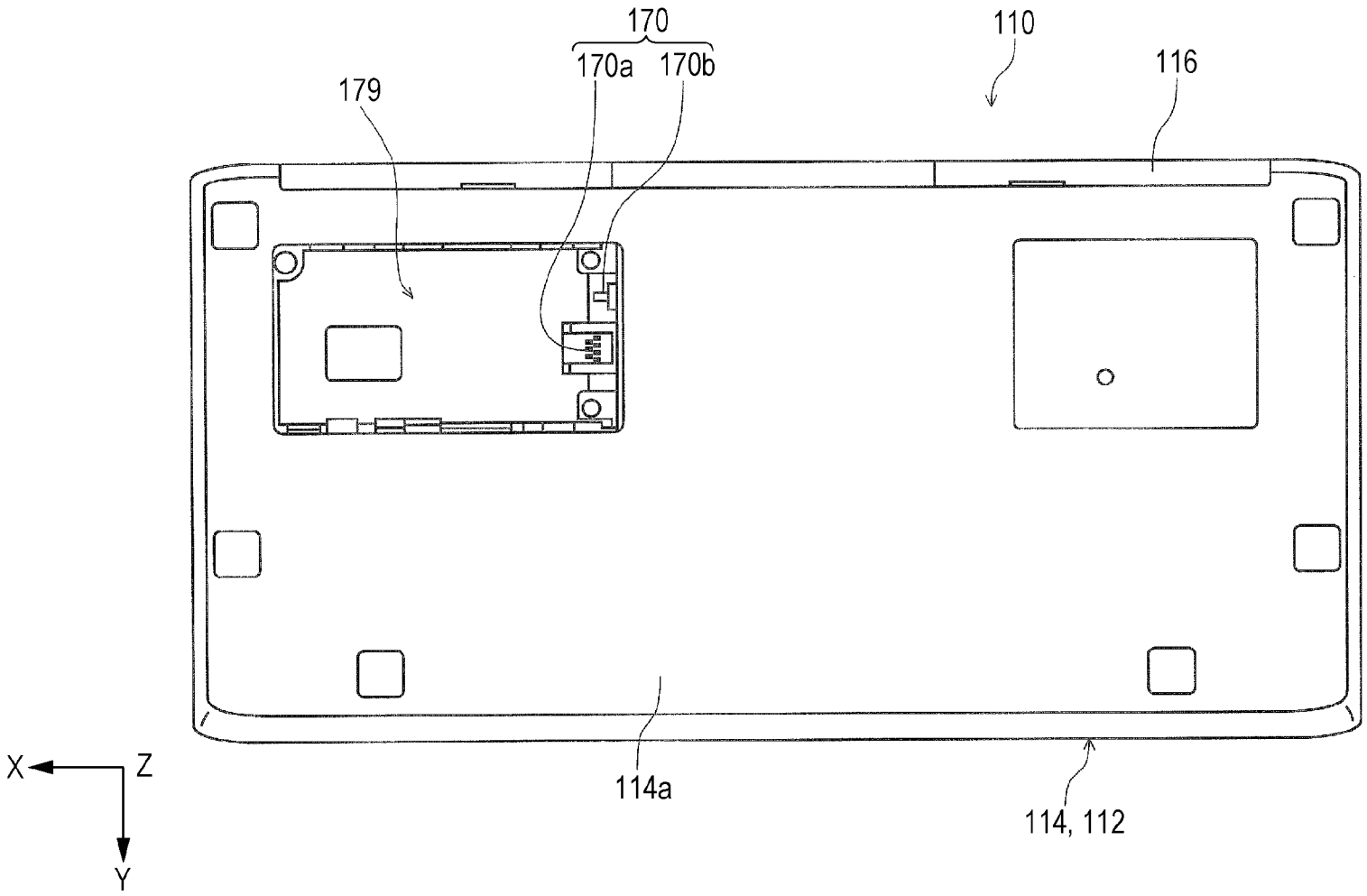
FIG. 24 is a planar view of the waste liquid cartridge accommodation unit.

FIG. 18 is a planar view of the platen and the cap when viewed from the lower side, FIG. 19 is a side cross-sectional view of the platen and the cap. FIG. 20 is a perspective view of the platen and the cap when viewed from the lower side, FIG. 21 is a perspective view of the waste liquid cartridge, FIG. 22 is a planar view of the printer in a state where the cover is attached to a waste liquid cartridge accommodation unit when viewed from the lower side, FIG. 23 is a planar view of the printer in a state where the waste liquid cartridge is accommodated in the waste liquid cartridge accommodation unit when viewed from the lower side, and FIG. 24 is a planar view of the waste liquid cartridge accommodation unit.

In an X-Y-Z coordinate system shown in each drawing, the X direction corresponds to the scanning direction of the recording head, the Y direction corresponds to the front-back direction of the recording apparatus, and the Z direction corresponds to the direction in which a distance (gap) between the recording head and the medium varies, that is, the apparatus height direction. In each drawing, the −Y direction corresponds to the front surface side of the apparatus, and the +Y direction corresponds to the rear surface side of the apparatus.

Outline of Printer

A description will be given of components in an ink jet printer 110 (hereinafter, referred to as a "printer 110") as an example of the recording apparatus with reference to FIGS. 12 and 13. The printer 110 includes an apparatus main body 112 (see FIG. 15), a housing 114 which covers the circumference of the apparatus main body 112 and configures an appearance of the printer 110, a cover 116 which can be opened and closed with respect to the apparatus main body 112, and an operation unit 118 which is exposed from the upper portion of the apparatus main body 112 when the cover 116 is in an opened posture.

The cover 116 configures a part of the upper surface and the front surface of the printer 110 in the closed state. The cover 116 is attached to the apparatus main body 112 so as to be turned. If the cover 116 is turned in the counterclockwise direction in FIG. 13 from the front side of the apparatus (the −Y direction in FIG. 13) toward the rear side of the apparatus (the +Y direction in FIG. 13) with respect to the apparatus main body 112, the cover 116 is brought into an opened posture as shown in FIG. 13. According to the embodiment, the inner surface of the cover 116 functions as a placement surface 116*a* of a sheet P as the "medium" when the cover 116 is in the opened posture with respect to the apparatus main body 112 as shown in FIG. 13.

If the cover 116 is changed from the closed posture (see FIG. 12) to the opened posture as shown in FIG. 13, the operation unit 118 and a sheet supply port 120 are exposed from the upper portion of the apparatus main body 112, and the discharge port 122 is exposed from the front surface of the apparatus main body 112. The operation unit 118 includes a power button, a print setting button, a display panel, and the like for operating the printer 110.

In addition, the sheet supply port 120 supplies a sheet P from the placement surface 116*a* to the inside of the apparatus main body 112 when the sheet P is placed on the placement surface 116*a* of the cover 116. Moreover, the discharge port 122 allows the sheet P supplied from the placement surface 116*a* to the inside of the apparatus main body 112 via the sheet supply port 120 to be discharged from the front surface side of the apparatus (from the side of the −Y direction in FIG. 13) in a state where recording is executed by a recording unit 124 which will be described later.

Next, a further detailed description will be given of components on the sheet transport path with reference to FIGS. 14 and 15. In FIG. 14, the right side in the paper (the rear surface side of the apparatus) corresponds to the upstream side of the feeding path, and the left side in the paper (the front surface side of the apparatus) corresponds to the downstream side of the feeding path. In addition, the broken line with the reference numeral 126 in FIG. 14 indicates a transport path of the sheet P.

On the upstream side of the feeding path, a sheet supply unit 128 which feeds a sheet from the placement surface 116*a* of the cover 116 in the opened state with respect to the housing 114 to the downstream side of the feeding path is provided. The sheet supply unit 128 includes a sheet supply port 120, a pair of sheet guides 130 provided at the sheet supply port, a sheet support unit 132 which supports at least a part of the sheet which is loaded from the sheet supply port 120, and a feeding roller 134 which is provided at a position at which the feeding roller 134 faces the sheet support unit 132. In addition, the cover 116 and the sheet support unit 132 support the sheet P in inclined postures.

The pair of sheet guides 130 include a sheet guide 130*a* positioned on the side of the +X direction and a sheet guide 130*b* positioned on the side of the −X direction in the X axis direction in FIGS. 13, 15, and 16. The sheet guide 130*a* is configured to be movable so as to approach and separate from, in the X axis direction, the sheet guide 130*b* positioned on the side of the −X direction. That is, the sheet guide 130*a* is provided such that the user can perform an operation of sliding the sheet guide 130*a* in the sheet width direction (X direction) in accordance with the sheet size.

The sheet support unit 132 is formed into a downwardly inclined state toward the side of the −Y direction in FIG. 14. In addition, the feeding roller 134 is configured so as to be able to swing in a direction in which the feeding roller 134 approaches and separates from the sheet P placed on the sheet support unit 132. The feeding roller 134 is brought into contact with the uppermost sheet P placed on the sheet support unit 132 and feeds the uppermost sheet P to the downstream side of the feeding path when being displaced in the direction in which the feeding roller 134 approaches the sheet support unit 132.

A transport unit 136 is provided on the downstream side of the sheet supply unit 128. The transport unit 136 is provided with a transport roller pair 138. The transport roller pair 138 is driven and rotated by a drive source which is not shown in the drawing. The transport unit 136 nips the sheet P fed from the sheet supply unit 128 between the transport roller pair 138 and transports the sheet P to the downstream side in the transport direction. A recording unit 124 is provided on the downstream side of the transport unit 136.

The recording unit 124 is provided with a carriage 140, a recording head 142 as the "liquid ejecting head" provided at the bottom of the carriage, and a platen 144 as the "medium support unit" which faces the recording head to support the medium. The recording head 142 faces the sheet P supported by the platen 144. The carriage 140 is driven to reciprocate in the X axis direction in FIG. 15 by a carriage drive motor 146 (see FIG. 15) which is controlled by a control unit (not shown) provided in the apparatus main body 112. In addition, the platen 144 defines a distance (gap) between a recording surface of the medium and a head surface of the recording head 142 by supporting the sheet P from the lower side.

The recording unit 124 executes recording by ejecting ink as the "liquid" from a plurality of nozzle holes (not shown) of the recording head 142 toward the sheet P when the sheet P supported by the platen 144 faces the recording head 142 and causing the ink to land on the recording surface (the surface which faces the recording head 142) of the sheet P.

A discharge unit 148 is provided on the downstream side of the recording unit 124 in the transport direction. The discharge unit 148 is provided with a discharge drive roller pair 150. The sheet P, on which the recording is performed by the recording unit 124, is nipped by the discharge drive roller pair 150 and is discharged from the discharge port 122 formed in the front surface of the apparatus toward the front side of the apparatus. In addition, the discharge drive roller pair 150 is driven and rotated by a drive motor which is not shown in the drawing. Concerning Platen, Waste Liquid Cartridge, and Ink Absorber A description will be given of configurations and arrangement of the platen 144, a waste liquid cartridge 168, and an ink absorber 160 with reference to FIGS. 15 to 20.

First, the carriage 140 is configured to be movable between an end in the −X direction and an end in the +X direction in the apparatus main body 112 as shown in FIG. 15. That is, a region between the end on the side of the −X direction and the end on the side of the +X direction in the apparatus main body 112 corresponds to a moving region of the carriage 140. In addition, the end of the moving region of the carriage 140 on the side of the −X direction is set to a home position in the embodiment.

As shown in FIG. 16, the platen 144 is arranged on the lower side of the carriage 140, namely on the side of the −Z direction of the carriage 140 in the moving region of the carriage 140. In addition, a cap mechanism 152 is provided at the end of the apparatus main body 112 on the side of the −X direction, namely on the home position side in the moving region of the carriage 140.

As shown in FIG. 18, a reinforcing member 153 extending in the X axis direction is attached to an end of a lower surface of the platen 144 on the side of the +Y direction. According to the embodiment, the reinforcing member 153 is formed by a material with high rigidity, and examples thereof include a metal material. The reinforcing member 153 suppresses bending of the platen 144 in the X axis direction. Therefore, it is possible to constantly keep the distance (gap) between the recording head 142 and the platen 144 in a moving region of the carriage 140.

On the upper surface of the platen 144, a plurality of ribs 154 for supporting the sheet P are provided with intervals in the X axis direction and in the Y axis direction. In addition, a concave portion 156 as the "liquid receiving unit" is provided in a part of a region of the platen 144 in the X axis direction, and an ink absorber 158 is arranged in the concave portion 156. According to the embodiment, the concave portion 156 is provided near the end on the side of the −X direction in the X axis direction, which is a direction intersecting the Y axis direction corresponding to the transport direction of the sheet P.

Here, examples of the sheet P on which recording can be performed by the printer 110 include not only a standard sheet but also an L-size photo sheet and a postcard. The printer 110 according to the embodiment is configured to be able to execute borderless recording for recording on the entire recording surface of a sheet with a small size (hereinafter, referred to as a "small-sized sheet") such as an L-size photo sheet or a postcard.

In the embodiment, the lengths of the concave portion 156 and the ink absorber 158 in the X axis direction are set to lengths with which the printer 110 can execute the borderless recording on the small-sized sheet. That is, the concave portion 156 and the ink absorber 158 are configured to be positioned in a region outside ends of the small-sized sheet.

According to the embodiment, the ink absorber 158 is configured of a sponge material. That is, the ink absorber 158 arranged in the concave portion 156 can absorb and temporarily store ink discarded in a region outside the ends of the small-sized sheet during the execution of the borderless recording.

In addition, a plurality of holes are provided in the bottom surface of the concave portion 156. The ink absorber 158 is provided with a plurality of tongue pieces 158*a* (see FIGS. 19 and 20) extending on the lower side of the platen 144 via the holes. The plurality of tongue pieces 158*a* abut the ink absorber 160 as the "first liquid storing unit" which is arranged on the lower side (on the side of the −Z direction) of the region where the concave portion 156 of the platen 144 is provided, namely the region where the ink absorber 158 is arranged.

The ink absorber 160 is arranged below the platen 144 as shown in FIGS. 18 and 19. In addition, the ink absorber 160 is provided so as to correspond to the length of the concave portion 156 (ink absorber 158) in the X axis direction in FIGS. 18 and 19. In addition, the ink absorber 160 according to the embodiment is configured of a sponge material in the same manner as the ink absorber 158.

According to the embodiment, the ink discarded during the execution of the borderless recording on the small-sized sheet is once absorbed by the ink absorber 158 arranged on the upper surface side of the platen 144, is then guided from the upper side to the lower side of the platen 144 via the tongue pieces 158*a*, and is absorbed and stored by the ink absorber 160 which abuts the tongue pieces 158*a*.

According to the embodiment, the ink absorber 160 is provided below the concave portion 156 for receiving the ink ejected toward the region outside the ends of the sheet P, and therefore, it is possible to quickly discharge the liquid from the concave portion 156 to the ink absorber 160.

Although not shown in the drawing, the ink absorber 160 is arranged in a concave portion which is provided at the bottom surface of the housing 114 which covers the apparatus main body 112. It is possible to suppress leakage of the ink, which is absorbed by the ink absorber 160, into the apparatus main body 112 by arranging the ink absorber 160 in the concave portion.

Referring back to FIGS. 16 to 18, an opening 144*a* is provided at an end of the platen 144 on the side of the −X direction, and the opening 144*a* is provided with a cap mechanism 152. That is, the cap mechanism 152 is adjacent to the ink absorber 158 arranged on the upper surface side of the platen 144 and the ink absorber 160 arranged on the lower surface side of the platen 144.

In addition, a pump 162 is provided on the side of the −Y axis direction of the cap mechanism 152 in the apparatus main body 112. The pump 162 is connected to the cap mechanism 152 by a waste ink tube 164.

The cap mechanism 152 can prevent the ink from drying by facing the recording head 142, being pressed onto a nozzle formation surface (not shown) of the recording head 142, and sealing the nozzle formation surface when the carriage 140 is located at a home position. In addition, the cap mechanism 152 is configured to be shifted between a sealing state of being pressed onto the recording head 142 and a separate state of being separate from the recording head 142.

If the pump 162 is driven when the cap mechanism 152 is in the sealing state with respect to the recording head 142, negative pressure is caused by the cap mechanism 152 via the waste ink tube 164. The ink is suctioned from the nozzles of the recording head 142 due to the negative pressure, and clogging and air bubble mixing of the nozzles can be solved.

In addition, a flushing operation is performed at a predetermined timing during execution of a recording operation by the printer 110. The flushing operation is an operation of temporarily moving the carriage 140 to the home position, ejecting the ink toward the cap mechanism 152, and discarding the ink.

The waste ink in the cap mechanism 152 is suctioned by the pump 162 via the waste ink tube 164. Then, the suctioned waste ink is accommodated in the waste liquid cartridge 168 as the "second liquid storing unit" which is connected to the waste ink tube 166 extending from the pump 162.

Next, a description will be given of handling of the waste ink tube 166 and arrangement thereof with respect to the platen 144 of the waste liquid cartridge 168 with reference to FIGS. 17 to 20. A cartridge attachment unit 170 to and from which the waste liquid cartridge 168 can be attached and detached is provided on the lower side (on the side of the −Z direction) of the platen 144. The waste liquid cartridge 168 in a state of being connected to the cartridge attachment unit 170 is arranged near the end of the platen 144 on the side of the +X direction on the lower side on the platen 144.

That is, the waste liquid cartridge 168 in the state of being connected to the cartridge attachment unit 170 is arranged in parallel with the ink absorber 160 in the Y axis direction. In addition, the waste ink tube 166 has one end connected to the pump 162 and the other end connected to the cartridge attachment unit 170.

The waste ink tube 166 is drawn from the lower side (the side of the −Z direction) of the platen 144. Specifically, the waste ink tube 166 drawn out from the pump 162 passes between the reinforcing member 153 and the ink absorber 160 at the end of the platen 144 on the side of the +Y direction and extends in the +X direction.

That is, the waste ink tube 166 extends at the end of the platen 144 on the side of the +Y direction from the −X direction to the +X direction. In addition, the waste ink tube 166 passes between the ink absorber 160 and the cartridge attachment unit 170, namely the waste liquid cartridge 168 in the X axis direction as shown in FIGS. 17 and 18, extends toward the side of the −Y direction, and is connected to the cartridge attachment unit 170 at a position, at which the waste ink tube faces the ink absorber 160, in the cartridge attachment unit 170 (waste liquid cartridge 168).

Therefore, the cap mechanism 152 communicates with the waste liquid cartridge 168 via the waste ink tube 166, the pump 162, and the waste ink tube 164 in the state where the waste liquid cartridge 168 is connected to the cartridge attachment unit 170. As a result, it is possible to store the ink, which is discarded in the cap mechanism 152 and is sent from the pump 162, in the waste liquid cartridge 168.

According to the embodiment, the waste ink tube 164 which connects the pump 162 to the waste liquid cartridge 168 passes between the ink absorber 160 and the waste liquid cartridge 168 and is connected at a position, at which the waste ink tube 164 faces the ink absorber 160, in the waste liquid cartridge 168, and therefore, it is not necessary to secure a region for disposing the waste ink tube 164 outside the waste liquid cartridge 168, and it is possible to reduce the size of the printer 110.

According to the embodiment, the waste liquid cartridge 168 and the ink absorber 160 have the following relationship with the platen 144. That is, the ink absorber 160 which is involved in the borderless recording and the waste liquid cartridge 168 which is involved in the nozzle maintenance require large spaces for occupancy inside the apparatus, which disrupts size reduction of the apparatus. In contrast, the platen 144 provided at a position, at which the platen 144 can face the recording head 142, for supporting the sheet P also requires a large space for occupancy in the recording surface direction, particularly the sheet width direction (X axis direction) of the sheet P, and the size thereof depends on the sheet size. Thus, according to the embodiment, a lower region (the region on the size of the −Z direction) of such a platen 144 is utilized for arranging both the ink absorber 160 and the waste liquid cartridge 168.

More specifically, the ink absorber 160 and the waste liquid cartridge 168 are arranged in parallel in the X axis direction which is a direction intersecting the Y axis direction corresponding to the transport direction of the sheet P below the platen 144 in the embodiment. It is possible to reduce the size of the apparatus while providing the waste liquid cartridge 168 and the ink absorber 160 by utilizing the lower region of the platen 144 for both the ink absorber 160 and the waste liquid cartridge 168 as described above.

According to the embodiment, the ink absorber 160 and the waste liquid cartridge 168 are arranged such that occupancy regions thereof are overlapped with each other in the Z axis direction corresponding to the apparatus height direction of the apparatus main body 112. Accordingly, since the occupancy regions of the ink absorber 160 and the waste liquid cartridge 168 are overlapped in the vertical direction, it is possible to reduce the size not only in the recording surface direction of the sheet P but also in the apparatus height direction.

In addition, the position of the bottom surface of the ink absorber 160 is the same as the position of the bottom surface of the waste liquid cartridge 168, namely the bottom surfaces are positioned in the same plane in the Z axis direction as shown in FIG. 19. That is, a bottom 114*a* (see FIG. 22) of the housing 114 supports the ink absorber 160 and the waste liquid cartridge 168 though not shown in FIG. 19.

That is, since the bottom surfaces of the ink absorber 160 and the waste liquid cartridge 168 are in the same plane, positions of the ink absorber 160 and the waste liquid cartridge 168 in the Z axis direction corresponding to the apparatus height direction coincide with each other, and it is possible to further reduce the size of the printer 110 in the apparatus height direction (Z axis direction).

In addition, since the ink absorber 160 and the waste liquid cartridge 168 are positioned below the platen 144 as a whole, that is, both the ink absorber 160 and the waste liquid cartridge 168 are not larger than the platen 144 in the X axis direction and the Y axis direction (see FIG. 17), it is possible to further reduce the size of the printer 110.

Concerning Configuration, Attachment, and Detachment of Waste Liquid Cartridge

Next, a more detailed description will be given of a configuration and an attachment and detachment method of the waste liquid cartridge 168 with reference to FIGS. 21 to 24. As shown in FIG. 21, the waste liquid cartridge 168 is provided with an IC substrate 172 and a waste ink flow port 174. The IC substrate 172 is provided with a storage device which stores information such as an amount of the waste ink accommodated in the waste liquid cartridge 168 and maintains information on the waste liquid cartridge 168.

As shown in FIG. 24, the cartridge attachment unit 170 is provided with an IC substrate connecting unit 170*a* and a waste ink flow port connecting unit 170*b*. The IC substrate connecting unit 170*a* is electrically connected to the IC substrate 172 in a state where the waste liquid cartridge 168 is connected to the cartridge attachment unit 170. In addition, the waste ink flow port connecting unit 170*b* is connected to the waste ink flow port 174 and is brought into a state of communicating with the cap mechanism 152 via the waste ink tube 166, the pump 162, and the waste ink tube 164.

Here, the IC substrate 172 is electrically connected to the control unit (not shown) provided in the apparatus main body 112 in a state where the waste liquid cartridge 168 is connected to the cartridge attachment unit 170. With such a configuration, information is transmitted between the IC substrate 172 and the control unit, namely from the IC substrate 172 to the control unit or from the control unit to the IC substrate 172.

The waste ink which is discarded or suctioned in the cap mechanism 152 can be accommodated in the waste liquid cartridge 168, and the waste liquid cartridge 168 is replaceable. Therefore, it is possible to continuously use the printer 110 by replacing the waste liquid cartridge 168 even if the accommodation limit thereof is reached before life duration of the printer 110 is expired.

Here, the control unit (not shown) in the apparatus main body 112 is electrically connected to the IC substrate 172 of the waste liquid cartridge 168 and receives information on the remaining amount of the wasted ink accommodated in the waste liquid cartridge 168, which is transmitted from the IC substrate 172. Then, if the waste ink accommodation capacity of the waste liquid cartridge 168 reaches the limit thereof and it becomes necessary to replace the waste liquid cartridge 168, then the control unit displays information for replacement of the waste liquid cartridge 168 on the display panel of the operation unit 118.

Accordingly, the user can recognize from the display on the display panel of the operation unit 118 that the accommodation limit of the waste liquid cartridge 168 has been reached and can replace the waste liquid cartridge 168 based on the information for replacement of the waste liquid cartridge 168, which is displayed on the display panel. Therefore, it is possible to replace the waste liquid cartridge 168 at an appropriate timing.

A description will be given of a replacement method of the waste liquid cartridge 168 in the apparatus main body 112. As shown in FIG. 22, a cover 176 which can be attached to and detached from the housing 114 is provided at the bottom 114*a* of the housing 114. The cover 176 configures a part of the bottom 114*a* along with the housing 114 in a state of being attached to the housing 114.

If the cover 176 is detached from the bottom 114*a* of the housing 114 as shown in FIG. 23, the waste liquid cartridge 168 in a state of being connected to the cartridge attachment unit 170 is exposed. In this state, the waste liquid cartridge 168 is made to slide in the +X direction. With such a configuration, the connection state between the IC substrate 172 and the IC substrate connecting unit 170*a* and the connection state between the waste ink flow port 174 and the waste ink flow port connecting unit 170*b*, namely the connection state between the waste liquid cartridge 168 and the cartridge attachment unit 170 is released. With such a configuration, it is possible to detach the waste liquid cartridge 168 from the apparatus main body 112.

Then, if the waste liquid cartridge 168 after use is detached from the apparatus main body 112 as shown in FIG. 24, a space (accommodation chamber 179) for accommodating the waste liquid cartridge, the IC substrate connecting unit 170*a*, and the waste ink flow port connecting unit 170*b* are exposed in the housing 114. If a new waste liquid cartridge 168 is accommodated in the space (in the accommodation chamber 179) in this state and is made to slide in the −X direction, the new waste liquid cartridge 168 is connected to the cartridge attachment unit 170. The position of the waste liquid cartridge 168 before the sliding operation is the "second position", and the position of the waste liquid cartridge 168 after the sliding operation is the "first position". If the cover 176 is then attached to the bottom 114*a* of the housing 114, the replacement of the waste liquid cartridge 168 is completed.

Since the waste liquid cartridge 168 is provided so as to be able to attached and detached, it is possible to elongate the life duration of the printer 110 as a whole by replacing the waste liquid cartridge 168 when the upper limit of the waste ink accommodation capacity of the waste liquid cartridge 168 has been reached.

In addition, since the embodiment is configured on the assumption of the replacement of the waste liquid cartridge 168, it is not necessary to increase the amount of accommodated waste ink by increasing the size of the waste liquid cartridge 168, and it is possible to reduce the size of the waste liquid cartridge 168. As a result, it is possible to accommodate the waste liquid cartridge 168 in the region below the platen 144 and to thereby further reduce the size of the printer 110.

In addition, the state shown in FIG. 23, that is, the state where the waste liquid cartridge 168 is connected to the cartridge attachment unit 170 (FIG. 24) represents a state where the waste liquid cartridge 168 is at the "first position". That is, the position corresponds to a position of the waste liquid cartridge 60 according to the first embodiment as shown in FIGS. 5, 10A and 10B. In such a state, a sliding region 178 as the "gap" for the waste liquid cartridge 168 is formed at an end on the side of the +X direction as shown in FIG. 23 in the accommodation chamber 179 (FIG. 24) for accommodating the waste liquid cartridge 168. If the cover 176 is attached as shown in FIG. 22 in this state, the stopper unit 177 formed at the cover 176 enters the sliding region 178 and restricts displacement of the waste liquid cartridge 168 in the +X direction.

With such a configuration, it is possible to reliably locate the waste liquid cartridge 168 at the first position even in the embodiment in the same manner as the aforementioned waste liquid cartridge 60 according to the first embodiment, the waste liquid cartridge 168 is held at the first position even if impact or vibration due to dropping-off of the printer 110 is applied, and it is possible to prevent the waste liquid cartridge 168 from dropping off from the printer 110.

As described above, the stopper unit 177 formed at the cover 176 so as to project toward the side of the accommodation chamber 179 achieves the same effects as those of the aforementioned stopper unit 96 according to the first embodiment.

If the above description is summarized, the printer 110 is provided with the apparatus main body 112 including the accommodation chamber 179 which detachably accommodates the waste liquid cartridge 168 as a cartridge capable of accommodating liquid and the cover 176 which opens and closes the accommodation chamber 179. In addition, the gap 178 is formed in the accommodation chamber 179 when the waste liquid cartridge 168 is attached to the accommodation chamber 179. If the cover 176 is closed in the state where the waste liquid cartridge 168 is attached to the accommodation chamber 179, the stopper unit 177 provided at the cover 176 enters the gap 178 according to the configuration.

Modification Examples of Embodiment (1) Although the ink absorber 160 and the waste liquid cartridge 168 are configured to be positioned below the platen 144 as a whole in the embodiment, another configuration is also applicable in which at least a part of the ink absorber 160 and at least a part of the waste liquid cartridge 168 are positioned below the platen 144, instead of the above configuration. That is, a configuration is also applicable in which the ink absorber 160 or the waste liquid cartridge 168 is partially located outside the platen 144 in FIG. 17.

(2) Although the home position of the carriage 140 is configured to be provided at the end of apparatus main body 112 on the side of the −X direction in the embodiment, the home position of the carriage 140 may be set at a position near the end of the apparatus main body 112 on the side of the +X direction, instead of the above configuration.

(3) Although the pump 162 is configured to be provided at the end of the apparatus main body 112 on the side of the −X direction in the embodiment, another configuration is also applicable in which the pump 162 is provided at the end of the apparatus main body 112 on the side of the +X direction, instead of the above configuration.

With such a configuration, it is possible to provide the pump 162 for sending the ink as the waste liquid to the waste liquid cartridge 168 and the waste liquid cartridge 168 for storing the ink sent from the pump 162 at positions near the end on the side of the +X direction, which is the same side in the X axis direction as a direction intersecting the Y axis direction corresponding to the transport direction of the sheet P, that is, it is possible to arrange the pump 162 and the waste liquid cartridge 168 in the vicinity of each other, and to thereby quickly discharge the liquid from the pump 162 to the waste liquid cartridge 168.

(4) Although the ink absorber 158 is configured to be provided as the liquid receiving unit in the concave portion 156 of the platen 144 in the embodiment, another configuration is also applicable in which only the concave portion 156 temporarily keep the ink discarded from the recording head 142 without arranging the ink absorber 158 in the concave portion 156, instead of the above configuration.

If the above description is summarized, the printer 110 according to the embodiment is provided with the recording head 142 which ejects the ink onto the sheet P, the platen 144 provided at a position, at which the platen 144 can face the recording head 142, for supporting the sheet P, the ink absorber 160 which stores the ink ejected to the region outside the ends of the sheet P and guided from the upper side to the lower side of the platen 144, and the waste liquid cartridge 168 which stores the ink ejected as the waste liquid from the recording head 142. At least a part of the ink absorber 160 and at least a part of the waste liquid cartridge 168 are positioned below the platen 144.

In addition, the ink absorber 160 and the waste liquid cartridge 168 are arranged in parallel with each other in the X axis direction which is a direction intersecting the Y axis direction corresponding to the transport direction of the sheet P.

In addition, the platen 144 is provided with the concave portion 156 which receives the ink ejected to the region outside the ends of the sheet P. The concave portion 156 is provided near the end of the platen 144 on the side of the −X direction in the X axis direction which is a direction intersecting the Y axis direction corresponding to the transport direction of the sheet P. The ink absorber 160 is provided below the concave portion 156 near the end on the side of the −X direction in the X axis direction which is a direction intersecting the Y axis direction corresponding to the transport direction of the sheet P. The waste liquid cartridge 168 is provided near the end on the side of the +X direction opposite to the end on the side of the −X direction.

In addition, the recording head 142 is provided at the carriage 140 capable of moving in the X axis direction which is a direction intersecting the Y axis direction corresponding to the transport direction of the sheet P. The home position of the carriage 140 is set to a position near the end on the side of the −X direction. Alternatively, the home position of the carriage 140 is set to a position near the end on the side of the X direction opposite to the end on the side of the −X axis direction.

The pump 162 which sends the ink as the waste liquid to the waste liquid cartridge 168 is provided at the position near the end on the side of the +X direction opposite to the end on the side of the −X direction, in the X axis direction which is a direction intersecting the Y axis direction corresponding to the transport direction of the sheet P. In addition, the waste ink tube 166 which connects the pump 162 to the waste liquid cartridge 168 passes between the ink absorber 160 and the waste liquid cartridge 168 and is connected at a position, at which the waste ink tube 166 faces the ink absorber 160, in the waste liquid cartridge 168.

The ink absorber 160 and the waste liquid cartridge 168 are positioned below the platen 144 as a whole. The occupancy regions of the ink absorber 160 and the waste liquid cartridge 168 are overlapped with each other in the apparatus height direction.

The bottom surfaces of the ink absorber 160 and the waste liquid cartridge 168 are in the same plane. The waste liquid cartridge 168 is provided so as to be able to attached to and detached from the printer 110.

Although the waste liquid cartridge 60 is applied to an ink jet printer as an example of the recording apparatus in the first embodiment and the ink absorber 160 and the waste liquid cartridge 168 according to the invention are applied to an ink jet printer as an example of the recording apparatus in the second embodiment, it is also possible to apply the invention to other general liquid ejecting apparatuses.

Here, examples of the liquid ejecting apparatuses include not only recording apparatuses such as a printer, a copy machine, and a facsimile, in each of which an ink jet recording head is used to eject ink from the recording head and perform recording on an recording medium, but also apparatuses which eject liquid corresponding to purposes instead of the ink from a liquid ejecting head corresponding to the ink jet recording head onto an ejection target medium corresponding to the recording medium and cause the liquid to adhere to the ejection target medium.

As the liquid ejecting head, it is possible to exemplify a color material ejecting head which is used for manufacturing a color filter for a liquid crystal display or the like, an electrode material (conductive paste) ejecting head which is used for forming electrodes for an organic EL display, a field emission display (FED), or the like, a bioorganic substance ejecting head which is used for manufacturing a bio chip, and a sample ejecting head as a precision pipette as well as the recording head.

The invention is not limited to the above embodiments, various modifications can be made within the scope of the invention described in claims, and it is a matter of course that the modifications are also included in the scope of the invention.

The entire disclosure of Japanese Patent Application No. 2013-158647 filed on Jul. 31, 2013, No. 2014-062082 filed on Mar. 25, 2014, and No. 2014-122129 filed on Jun. 13, 2014 are expressly incorporated by reference herein.

What is claimed is:

1. A recording apparatus comprising:

an apparatus main body which includes an accommodation chamber for detachably accommodating a cartridge that accommodates liquid; and a cover which opens and closes the accommodation chamber, wherein when the cartridge is attached to the accommodation chamber and moved in a first direction, a gap is formed in the accommodation chamber, and wherein when the cover is closed in a state where the cartridge is attached to the accommodation chamber, a stopper unit provided at the cover enters the gap and pushes the cartridge in the first direction as the cartridge moves in a direction intersecting the first direction.

2. The apparatus according to claim 1, wherein a connected unit which is connected to a liquid flow port provided at the cartridge is provided in the accommodation chamber, wherein the cartridge is slidable between a first position where the liquid flow port is connected to the connected unit and a second position where the connection to the connected unit is released when attached to the accommodation chamber, and wherein the stopper unit provided at the cover enters a sliding region where the cartridge slides from the first position to a side of the second position when the cover is closed in a state where the cartridge is at the first position in the accommodation chamber.

3. The apparatus according to claim 2, wherein the accommodation chamber includes an engaging unit which engages with an engaged unit provided at the cartridge when the cartridge is made to slide from the second position to the first position, and wherein at least one of an engagement sound or a clicking sensation is generated when the engaged unit is engaged with the engaging unit while the cartridge slides from the second position to the first position.

4. The apparatus according to claim 2, wherein the accommodation chamber includes a restricting unit which restricts dropping-off of the cartridge from the accommodation chamber, wherein a restricted unit, dropping-off of which is restricted by the restricting unit, is not engaged with the restricting unit in the cartridge when the cartridge is at the second position, and wherein the restricted unit is engaged with the restricting unit by the cartridge sliding from the second position to the first position.

5. The apparatus according to claim 2, wherein the connected unit is biased in a direction from the first position toward the second position.

6. The apparatus according to claim 1, wherein the stopper unit of the cover includes a guide surface provided at a part which abuts the cartridge when the cover is closed with respect to the apparatus main body.

7. The apparatus according to claim 1, wherein the cartridge accommodates ink as the liquid which is discharged from the apparatus main body.

8. The apparatus according to claim 7, wherein the cartridge includes an ink absorbing member provided therein.

9. The apparatus according to claim 1, wherein the cartridge accommodates ink to be supplied to a recording head which is provided in the apparatus main body and ejects the ink.

10. The apparatus according to claim 1, further comprising:

a liquid ejecting head which ejects liquid onto a medium;

a medium support unit which is provided at a position where the medium support unit faces the liquid ejecting head and supports the medium;

a first liquid storing unit which stores the liquid ejected to a region outside an end of the medium and guided from an upper side to a lower side of the medium support unit; and a second liquid storing unit as the cartridge which stores liquid ejected as waste liquid from the liquid ejecting head, wherein at least a part of the first liquid storing unit and at least a part of the second liquid storing unit are positioned below the medium support unit, wherein the first liquid storing unit and the second liquid storing unit are arranged in parallel with a transport direction of the medium, wherein the medium support unit includes a liquid receiving unit which receives the liquid ejected to the region outside the end of the medium, wherein the liquid receiving unit is provided at a location near an end of the medium support unit on one side in a direction intersecting the transport direction of the medium, wherein the first liquid storing unit is provided below the liquid receiving unit at a location near the end on the one side in the direction intersecting the transport direction of the medium, and wherein the second liquid storing unit is provided at a location near an end on the opposite side to the end on the one side.

11. The apparatus according to claim 10, wherein a tube, which connects a pump for sending the liquid as the waste liquid to the second liquid storing unit, passes between the first liquid storing unit and the second liquid storing unit and is connected to a position in the second liquid storing unit at which the second liquid storing unit faces the first liquid storing unit.

12. The apparatus according to claim 10, wherein the first liquid storing unit and the second liquid storing unit are positioned below the medium support unit as a whole.

13. The apparatus according to claim 1, wherein the cartridge comprises a guide groove which extends in the direction intersecting the first direction and a restricted unit which extends in the first direction and which connects with the guide groove, a restricting unit is provided in the accommodation chamber, a width of the guide groove is larger than the width of the restricting unit, and the restricted unit is restricted by the restricting unit when the cartridge is attached to the accommodation chamber.

14. The apparatus according to claim 2, wherein the cartridge comprises a guide member adjacent to the liquidflow port, a guided member adjacent to the connected unit is provided in the accommodation chamber, and the guided member is guided by the guide member when the cartridge is attached to the accommodation chamber.

* * * * *